US008825486B2

(12) United States Patent
Meyer et al.

(10) Patent No.: US 8,825,486 B2
(45) Date of Patent: Sep. 2, 2014

(54) METHOD AND APPARATUS FOR GENERATING SYNTHETIC SPEECH WITH CONTRASTIVE STRESS

(71) Applicant: Nuance Communications, Inc., Burlington, MA (US)

(72) Inventors: Darren C. Meyer, Duxbury, MA (US); Stephen R. Springer, Needham, MA (US)

(73) Assignee: Nuance Communications, Inc., Burlington, MA (US)

( * ) Notice: Subject to any disclaimer, the term of this patent is extended or adjusted under 35 U.S.C. 154(b) by 0 days.

(21) Appl. No.: 14/161,535

(22) Filed: Jan. 22, 2014

(65) Prior Publication Data

US 2014/0129230 A1 May 8, 2014

Related U.S. Application Data

(63) Continuation of application No. 13/864,831, filed on Apr. 17, 2013, now Pat. No. 8,682,671, which is a continuation of application No. 12/853,026, filed on Aug. 9, 2010, now Pat. No. 8,447,610, which is a continuation-in-part of application No. 12/704,859, filed on Feb. 12, 2010.

(51) Int. Cl.
*G10L 13/00* (2006.01)
*G10L 13/02* (2013.01)

(52) U.S. Cl.
CPC ..... *G10L 13/02* (2013.01)
USPC ..... 704/260; 704/271; 704/258; 704/234; 704/209; 434/236; 434/178

(58) Field of Classification Search
CPC ..... G09B 21/009; G10L 13/08; G10L 15/20; G10L 21/04
USPC ..... 704/271, 260, 258, 234, 209; 434/236, 434/178
See application file for complete search history.

(56) References Cited

U.S. PATENT DOCUMENTS 5,652,828 A 7/1997 Silverman
5,668,926 A 9/1997 Karaali et al.

(Continued)

OTHER PUBLICATIONS

Forney, "The Viterbi Algorithm" Proc. IEEE, v. 61, pp. 268-278, 1973.

(Continued)

*Primary Examiner* — Michael Colucci
(74) *Attorney, Agent, or Firm* — Wolf, Greenfield & Sacks, P.C.

(57) ABSTRACT

Techniques for generating synthetic speech with contrastive stress. In one aspect, a speech-enabled application generates a text input including a text transcription of a desired speech output, and inputs the text input to a speech synthesis system. The synthesis system generates an audio speech output corresponding to at least a portion of the text input, with at least one portion carrying contrastive stress, and provides the audio speech output for the speech-enabled application. In another aspect, a speech-enabled application inputs a plurality of text strings, each corresponding to a portion of a desired speech output, to a software module for rendering contrastive stress. The software module identifies a plurality of audio recordings that render at least one portion of at least one of the text strings as speech carrying contrastive stress. The speech-enabled application generates an audio speech output corresponding to the desired speech output using the audio recordings.

20 Claims, 9 Drawing Sheets

(56) References Cited

U.S. PATENT DOCUMENTS

| | | | | |
|---|---|---|---|---|
| 5,860,064 | A | 1/1999 | Henton | |
| 6,035,271 | A | 3/2000 | Chen | |
| 6,081,780 | A | 6/2000 | Lumelsky | |
| 6,101,470 | A | 8/2000 | Eide et al. | |
| 6,266,637 | B1 | 7/2001 | Donovan et al. | |
| 6,345,250 | B1 | 2/2002 | Martin | |
| 6,389,396 | B1 * | 5/2002 | Lyberg | 704/258 |
| 6,446,040 | B1 | 9/2002 | Socher et al. | |
| 6,665,641 | B1 * | 12/2003 | Coorman et al. | 704/260 |
| 6,810,378 | B2 | 10/2004 | Kochanski et al. | |
| 6,865,533 | B2 | 3/2005 | Addison et al. | |
| 7,401,020 | B2 | 7/2008 | Eide | |
| 7,455,522 | B2 * | 11/2008 | Polanyi et al. | 434/178 |
| 7,519,531 | B2 * | 4/2009 | Acero et al. | 704/209 |
| 7,565,292 | B2 * | 7/2009 | Deng et al. | 704/260 |
| 7,643,998 | B2 | 1/2010 | Yuen et al. | |
| 7,899,672 | B2 | 3/2011 | Qin et al. | |
| 8,126,716 | B2 | 2/2012 | Dhanakshirur et al. | |
| 8,447,610 | B2 | 5/2013 | Meyer et al. | |
| 8,571,870 | B2 | 10/2013 | Meyer et al. | |
| 2002/0072908 | A1 * | 6/2002 | Case et al. | 704/260 |
| 2002/0133348 | A1 | 9/2002 | Pearson et al. | |
| 2004/0030555 | A1 * | 2/2004 | van Santen | 704/260 |
| 2004/0049391 | A1 * | 3/2004 | Polanyi et al. | 704/271 |
| 2004/0078201 | A1 | 4/2004 | Porter et al. | |
| 2004/0138887 | A1 | 7/2004 | Rusnak et al. | |
| 2004/0197750 | A1 * | 10/2004 | Donaher et al. | 434/236 |
| 2005/0027523 | A1 * | 2/2005 | Tarlton et al. | 704/234 |
| 2005/0071163 | A1 | 3/2005 | Aaron et al. | |
| 2005/0125232 | A1 | 6/2005 | Gadd | |
| 2007/0043568 | A1 | 2/2007 | Dhanakshirur et al. | |
| 2007/0192105 | A1 | 8/2007 | Neeracher et al. | |
| 2008/0167875 | A1 | 7/2008 | Bakis et al. | |
| 2009/0048843 | A1 * | 2/2009 | Nitisaroj et al. | 704/260 |
| 2009/0157385 | A1 | 6/2009 | Tian | |
| 2010/0100377 | A1 | 4/2010 | Madhavapeddi et al. | |
| 2011/0202344 | A1 | 8/2011 | Meyer et al. | |
| 2011/0202345 | A1 | 8/2011 | Meyer et al. | |
| 2011/0202346 | A1 | 8/2011 | Meyer et al. | |
| 2012/0130718 | A1 | 5/2012 | Dhanakshirur et al. | |
| 2013/0231935 | A1 | 9/2013 | Meyer et al. | |

OTHER PUBLICATIONS

Natural Playback Modules (NPM), Nuance Professional Services.

Saon et al., "Maximum Likelihood Discriminant Feature Spaces," 2000, IEEE International Conference on Acoustics, Speech, and Signal Processing, vol. 2, Jun. 5-9, 2000, pp. 1129-1132.

* cited by examiner

METHOD AND APPARATUS FOR GENERATING SYNTHETIC SPEECH WITH CONTRASTIVE STRESS

CROSS-REFERENCE TO RELATED APPLICATIONS

This application is a continuation of U.S. application Ser. No. 13/864,831, entitled "Method and Apparatus for Generating Synthetic Speech with Contrastive Stress" and filed on Apr. 17, 2013, which is incorporated herein by reference in its entirety. U.S. application Ser. No. 13/864, 831 is a continuation of U.S. application Ser. No. 12/853,026, entitled "Method and Apparatus for Generating Synthetic Speech with Contrastive Stress" and filed on Aug. 9, 2010, which is incorporated herein by reference in its entirety. U.S. application Ser. No. 12/853,026 is a continuation-in-part of U.S. application Ser. No. 12/704,859, entitled "Method and Apparatus for Providing Speech Output for Speech-Enabled Applications" and filed on Feb. 12, 2010 (now pending), which is incorporated herein by reference in its entirety.

BACKGROUND OF INVENTION

1. Field of Invention

The techniques described herein are directed generally to the field of speech synthesis, and more particularly to techniques for synthesizing speech with contrastive stress.

2. Description of the Related Art

Speech-enabled software applications exist that are capable of providing output to a human user in the form of speech. For example, in an interactive voice response (IVR) application, a user typically interacts with the software application using speech as a mode of both input and output. Speech-enabled applications are used in many different contexts, such as telephone call centers for airline flight information, banking information and the like, global positioning system (GPS) devices for driving directions, e-mail, text messaging and web browsing applications, handheld device command and control, and many others. When a user communicates with a speech-enabled application by speaking, automatic speech recognition is typically used to determine the content of the user's utterance and map it to an appropriate action to be taken by the speech-enabled application. This action may include outputting to the user an appropriate response, which is rendered as audio speech output through some form of speech synthesis (i.e., machine rendering of speech). Speech-enabled applications may also be programmed to output speech prompts to deliver information or instructions to the user, whether in response to a user input or to other triggering events recognized by the running application. Examples of speech-enabled applications also include applications that output prompts as speech but receive user input through non-speech input methods, applications that receive user input through speech in addition to non-speech input methods, and applications that produce speech output in addition to other non-speech forms of output.

Techniques for synthesizing output speech prompts to be played to a user as part of an IVR dialog or other speech-enabled application have conventionally been of two general forms: concatenated prompt recording and text to speech synthesis. Concatenated prompt recording (CPR) techniques require a developer of the speech-enabled application to specify the set of speech prompts that the application will be capable of outputting, and to code these prompts into the application. Typically, a voice talent (i.e., a particular human speaker) is engaged during development of the speech-enabled application to speak various word sequences or phrases that will be used in the output speech prompts of the running application. These spoken word sequences are recorded and stored as audio recording files, each referenced by a particular filename. When specifying an output speech prompt to be used by the speech-enabled application, the developer designates a particular sequence of audio prompt recording files to be concatenated (e.g., played consecutively) to form the speech output.

FIG. 1A illustrates steps involved in a conventional CPR process to synthesize an example desired speech output 110. In this example, the desired speech output 110 is, "Arriving at 221 Baker St. Please enjoy your visit." Desired speech output 110 could represent, for example, an output prompt to be played to a user of a GPS device upon arrival at a destination with address 221 Baker St. To specify that such an output prompt should be synthesized through CPR in response to the detection of such a triggering event by the speech-enabled application, a developer would enter the output prompt into the application software code. An example of the substance of such code is given in FIG. 1A as example input code 120.

Input code 120 illustrates example pieces of code that a developer of a speech-enabled application would enter to instruct the application to form desired speech output 110 through conventional CPR techniques. Through input code 120, the developer directly specifies which pre-recorded audio files should be used to render each portion of desired speech output 110. In this example, the beginning portion of the speech output, "Arriving at", corresponds to an audio file named "i.arrive.wav", which contains pre-recorded audio of a voice talent speaking the word sequence "Arriving at" at the beginning of a sentence. Similarly, an audio file named "m.address.hundreds2.wav" contains pre-recorded audio of the voice talent speaking the number "two" in a manner appropriate for the hundreds digit of an address in the middle of a sentence, and an audio file named "m.address.units21.wav" contains pre-recorded audio of the voice talent speaking "twenty-one" in a manner appropriate for the units of an address in the middle of a sentence. These audio files are selected and ordered as a sequence of audio segments 130, which are ultimately concatenated to form the speech output of the speech-enabled application. To specify that these particular audio files be selected for the various portions of the desired speech output 110, the developer of the speech-enabled application enters their filenames (i.e., "i.arrive.wav", "m.address.hundreds2.wav", etc.) into input code 120 in the proper sequence.

For some specific types of desired speech output portions (generally conveying numeric information), such as the address number "221" in desired speech output 110, an application using conventional CPR techniques can also issue a call-out to a separate library of function calls for mapping those specific word types to audio recording filenames. For example, for the "221" portion of desired speech output 110, input code 120 could contain code that calls the name of a specific function for mapping address numbers in English to sequences of audio filenames and passes the number "221" to that function as input. Such a function would then apply a hard coded set of language-specific rules for address numbers in English, such as a rule indicating that the hundreds place of an address in English maps to a filename in the form of "m.address.hundreds_.wav" and a rule indicating that the tens and units places of an address in English map to a filename in the form of "m.address.units_.wav". To make use of such function calls, a developer of a speech-enabled application would be required to supply audio recordings of the specific words in the specific contexts referenced by the function calls, and to name those audio recording files using the specific filename formats referenced by the function calls.

In the example of FIG. 1A, the "Baker" portion of desired speech output 110 does not correspond to any available audio recordings pre-recorded by the voice talent. For example, in many instances it can be impractical to engage the voice talent to pre-record speech audio for every possible street name that a GPS application may eventually need to include in an output speech prompt. For such desired speech output portions that do not match any pre-recorded audio, speech-enabled applications relying primarily on CPR techniques are typically programmed to issue call-outs (in a program code form similar to that described above for calling out to a function library) to a separate text to speech (TTS) synthesis engine, as represented in portion 122 of example input code 120. The ITS engine then renders that portion of the desired speech output as a sequence of separate subword units such as phonemes, as represented in portion 132 of the example sequence of audio segments 130, rather than a single audio recording as produced naturally by a voice talent.

Text to speech (TTS) synthesis techniques allow any desired speech output to be synthesized from a text transcription (i.e., a spelling out, or orthography, of the sequence of words) of the desired speech output. Thus, a developer of a speech-enabled application need only specify plain text transcriptions of output speech prompts to be used by the application, if they are to be synthesized by TTS. The application may then be programmed to access a separate TTS engine to synthesize the speech output. Some conventional TTS engines produce output audio using concatenative text to speech synthesis, whereby the input text transcription of the desired speech output is analyzed and mapped to a sequence of subword units such as phonemes (or phones, allophones, etc.). The concatenative TTS engine typically has access to a database of small audio files, each audio file containing a single subword unit (e.g., a phoneme or a portion of a phoneme) excised from many hours of speech pre-recorded by a voice talent. Complex statistical models are applied to select preferred subword units from this large database to be concatenated to form the particular sequence of subword units of the speech output.

Other techniques for TTS synthesis exist that do not involve recording any speech from a voice talent. Such TTS synthesis techniques include formant synthesis and articulatory synthesis, among others. In formant synthesis, an artificial sound waveform is generated and shaped to model the acoustics of human speech. A signal with a harmonic spectrum, similar to that produced by human vocal folds, is generated and filtered using resonator models to impose spectral peaks, known as formants, on the harmonic spectrum. The formants are positioned to represent the changing resonant frequencies of the human vocal tract during speech. Parameters such as amplitude of periodic voicing, fundamental frequency, turbulence noise levels, formant frequencies and bandwidths, spectral tilt and the like are varied over time to generate the sound waveform emulating a sequence of speech sounds. In articulatory synthesis, an artificial glottal source signal, similar to that produced by human vocal folds, is filtered using computational models of the human vocal tract and of the articulatory processes that change the shape of the vocal tract to make speech sounds. Each of these TTS synthesis techniques (e.g., concatenative TTS synthesis, articulatory synthesis and formant synthesis) typically involves representing the input text as a sequence of phonemes, and applying complex models (acoustic and/or articulatory) to generate output sound for each phoneme in its specific context within the sequence.

In addition to sometimes being used to fill in small gaps in CPR speech output, as illustrated in FIG. 1A, TTS synthesis is sometimes used to implement a system for synthesizing speech output that does not employ CPR at all, but rather uses only TTS to synthesize entire speech output prompts, as illustrated in FIG. 1B. FIG. 1B illustrates steps involved in conventional full concatenative TTS synthesis of the same desired speech output 110 that was synthesized using CPR techniques in FIG. 1A. In the TTS example of FIG. 1B, a developer of a speech-enabled application specifies the output prompt by programming the application to submit plain text input to a TTS engine. The example text input 150 is a plain text transcription of desired speech output 110, submitted to the TTS engine as, "Arriving at 221 Baker St. Please enjoy your visit." The TTS engine typically applies language models to determine a sequence of phonemes corresponding to the text input, such as phoneme sequence 160. The TTS engine then applies further statistical models to select small audio files from a database, each small audio file corresponding to one of the phonemes (or a portion of a phoneme, such as a demiphone, or half-phone) in the sequence, and concatenates the resulting sequence of audio segments 170 in the proper sequence to form the speech output.

The concatenative TTS database typically contains a large number of phoneme audio files excised from long recordings of the speech of a voice talent. Each phoneme is typically represented by multiple audio files excised from different times the phoneme was uttered by the voice talent in different contexts (e.g., the phoneme/t/could be represented by an audio file excised from the beginning of a particular utterance of the word "tall", an audio file excised from the middle of an utterance of the word "battle", an audio file excised from the end of an utterance of the word "pat", two audio files excised from an utterance of the word "stutter", and many others). Statistical models are used by the TTS engine to select the best match from the multiple audio files for each phoneme given the context of the particular phoneme sequence to be synthesized. The long recordings from which the phoneme audio files in the database are excised are typically made with the voice talent reading a generic script, unrelated to any particular speech-enabled application in which the TTS engine will eventually be employed.

SUMMARY OF INVENTION

One embodiment is directed to a method for providing speech output for a speech-enabled application, the method comprising receiving from the speech-enabled application a text input comprising a text transcription of a desired speech output; generating, using at least one computer system, an audio speech output corresponding to at least a portion of the text input, the audio speech output comprising at least one portion carrying contrastive stress to contrast with at least one other portion of the audio speech output; and providing the audio speech output for the speech-enabled application.

Another embodiment is directed to apparatus for providing speech output for a speech-enabled application, the apparatus comprising a memory storing a plurality of processor-executable instructions, and at least one processor, operatively coupled to the memory, that executes the instructions to receive from the speech-enabled application a text input comprising a text transcription of a desired speech output; generate an audio speech output corresponding to at least a portion of the text input, the audio speech output comprising at least one portion carrying contrastive stress to contrast with at least one other portion of the audio speech output; and provide the audio speech output for the speech-enabled application.

Another embodiment is directed to at least one non-transitory computer-readable storage medium encoded with a plurality of computer-executable instructions that, when executed, perform a method for providing speech output for a speech-enabled application, the method comprising receiving from the speech-enabled application a text input comprising a text transcription of a desired speech output; generating an audio speech output corresponding to at least a portion of the text input, the audio speech output comprising at least one portion carrying contrastive stress to contrast with at least one other portion of the audio speech output; and providing the audio speech output for the speech-enabled application.

Another embodiment is directed to a method for providing speech output via a speech-enabled application, the method comprising generating, using at least one computer system executing the speech-enabled application, a text input comprising a text transcription of a desired speech output; inputting the text input to at least one speech synthesis engine; receiving from the at least one speech synthesis engine an audio speech output corresponding to at least a portion of the text input, the audio speech output comprising at least one portion carrying contrastive stress to contrast with at least one other portion of the audio speech output; and providing the audio speech output to at least one user of the speech-enabled application.

Another embodiment is directed to apparatus for providing speech output via a speech-enabled application, the apparatus comprising a memory storing a plurality of processor-executable instructions, and at least one processor, operatively coupled to the memory, that executes the instructions to generate a text input comprising a text transcription of a desired speech output; input the text input to at least one speech synthesis engine; receive from the at least one speech synthesis engine an audio speech output corresponding to at least a portion of the text input, the audio speech output comprising at least one portion carrying contrastive stress to contrast with at least one other portion of the audio speech output; and provide the audio speech output to at least one user of the speech-enabled application.

Another embodiment is directed to at least one non-transitory computer-readable storage medium encoded with a plurality of computer-executable instructions that, when executed, perform a method for providing speech output via a speech-enabled application, the method comprising generating a text input comprising a text transcription of a desired speech output; inputting the text input to at least one speech synthesis engine; receiving from the at least one speech synthesis engine an audio speech output corresponding to at least a portion of the text input, the audio speech output comprising at least one portion carrying contrastive stress to contrast with at least one other portion of the audio speech output; and providing the audio speech output to at least one user of the speech-enabled application.

Another embodiment is directed to a method for use with a speech-enabled application, the method comprising receiving input from the speech-enabled application comprising a plurality of text strings; generating, using at least one computer system, speech synthesis output corresponding to the plurality of text strings, the speech synthesis output identifying a plurality of audio recordings to render the plurality of text strings as speech, at least one of the plurality of audio recordings being selected to render at least one portion of at least one of the plurality of text strings as speech carrying contrastive stress, to contrast with at least one rendering of at least one other of the plurality of text strings; and providing the speech synthesis output for the speech-enabled application.

Another embodiment is directed to apparatus for use with a speech-enabled application, the apparatus comprising a memory storing a plurality of processor-executable instructions, and at least one processor, operatively coupled to the memory, that executes the instructions to receive input from the speech-enabled application comprising a plurality of text strings; generate speech synthesis output corresponding to the plurality of text strings, the speech synthesis output identifying a plurality of audio recordings to render the plurality of text strings as speech, at least one of the plurality of audio recordings being selected to render at least one portion of at least one of the plurality of text strings as speech carrying contrastive stress, to contrast with at least one rendering of at least one other of the plurality of text strings; and provide the speech synthesis output for the speech-enabled application.

Another embodiment is directed to at least one non-transitory computer-readable storage medium encoded with a plurality of computer-executable instructions that, when executed, perform a method for use with a speech-enabled application, the method comprising receiving input from the speech-enabled application comprising a plurality of text strings; generating speech synthesis output corresponding to the plurality of text strings, the speech synthesis output identifying a plurality of audio recordings to render the plurality of text strings as speech, at least one of the plurality of audio recordings being selected to render at least one portion of at least one of the plurality of text strings as speech carrying contrastive stress, to contrast with at least one rendering of at least one other of the plurality of text strings; and providing the speech synthesis output for the speech-enabled application.

Another embodiment is directed to a method for generating speech output via a speech-enabled application, the method comprising generating, using at least one computer system executing the speech-enabled application, a plurality of text strings, each of the plurality of text strings corresponding to a portion of a desired speech output; inputting the plurality of text strings to at least one software module for rendering contrastive stress; receiving output from the at least one software module, the output identifying a plurality of audio recordings to render the plurality of text strings as speech, at least one of the plurality of audio recordings being selected to render at least one portion of at least one of the plurality of text strings as speech carrying contrastive stress, to contrast with at least one rendering of at least one other of the plurality of text strings; and generating, using the plurality of audio recordings, an audio speech output corresponding to the desired speech output.

Another embodiment is directed to apparatus for generating speech output via a speech-enabled application, the apparatus comprising a memory storing a plurality of processor-executable instructions, and at least one processor, operatively coupled to the memory, that executes the instructions to generate a plurality of text strings, each of the plurality of text strings corresponding to a portion of a desired speech output; input the plurality of text strings to at least one software module for rendering contrastive stress; receive output from the at least one software module, the output identifying a plurality of audio recordings to render the plurality of text strings as speech, at least one of the plurality of audio recordings being selected to render at least one portion of at least one of the plurality of text strings as speech carrying contrastive stress, to contrast with at least one rendering of at least one other of the plurality of text strings; and generate, using the plurality of audio recordings, an audio speech output corresponding to the desired speech output.

Another embodiment is directed to at least one non-transitory computer-readable storage medium encoded with a plurality of computer-executable instructions that, when executed, perform a method for generating speech output via a speech-enabled application, the method comprising generating a plurality of text strings, each of the plurality of text strings corresponding to a portion of a desired speech output; inputting the plurality of text strings to at least one software module for rendering contrastive stress; receiving output from the at least one software module, the output identifying a plurality of audio recordings to render the plurality of text strings as speech, at least one of the plurality of audio recordings being selected to render at least one portion of at least one of the plurality of text strings as speech carrying contrastive stress, to contrast with at least one rendering of at least one other of the plurality of text strings; and generating, using the plurality of audio recordings, an audio speech output corresponding to the desired speech output.

BRIEF DESCRIPTION OF DRAWINGS

The accompanying drawings are not intended to be drawn to scale. In the drawings, each identical or nearly identical component that is illustrated in multiple figures is represented by a like numeral. For purposes of clarity, not every component may be labeled in every drawing. In the drawings.

DETAILED DESCRIPTION

Figure 1A:
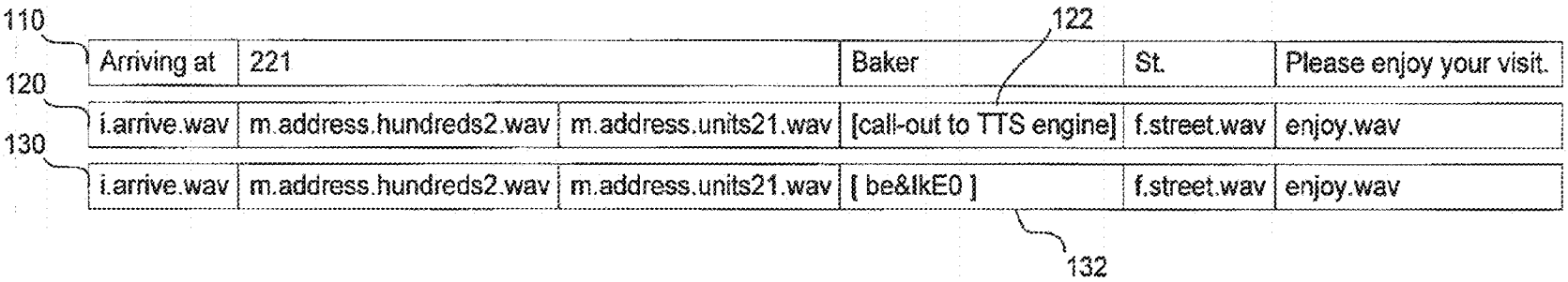
FIG. 1A (Prior Art)
FIG. 1A illustrates an example of conventional concatenated prompt recording (CPR) synthesis.

Applicants have recognized that conventional speech output synthesis techniques for speech-enabled applications suffer from various drawbacks. Conventional CPR techniques, as discussed above, require a developer of the speech-enabled application to hard code the desired output speech prompts with the filenames of the specific audio files of the prompt recordings that will be concatenated to form the speech output. This is a time consuming and labor intensive process requiring a skilled programmer of such systems. This also requires the speech-enabled application developer to decide, prior to programming the application's output speech prompts, which portions of each prompt will be pre-recorded by a voice talent and which will be synthesized through call-outs to a TTS engine. Conventional CPR techniques also require the application developer to remember or look up the appropriate filenames to code in each portion of the desired speech output that will be produced using a prompt recording. In addition, the resulting code (e.g., input code 120 in FIG. 1A) is not easy to read or to intuitively associate with the words of the speech output, which can lead to frustration and wasted time during programming, debugging and updating processes.

By contrast, conventional TTS techniques allow the speech-enabled application developer to specify desired output speech prompts using plain text transcriptions. This results in a relatively less time consuming programming process, which may require relatively less skill in programming. However, the state of the art in TTS synthesis technology typically produces speech output that is relatively monotone and flat, lacking the naturalness and emotional expressiveness of the naturally produced human speech that can be provided by a recording of a speaker speaking a prompt. For instance, Applicants have recognized that conventional TTS synthesis systems do not synthesize speech with contrastive stress, in which a particular emphasis pattern is applied in speech to words or syllables that are meant to contrast with each other. Human speakers naturally apply contrastive stress to emphasize a word or syllable contrary to its normal accentuation, in order to contrast it with an alternative word or syllable or to focus attention on it. A common example is the stress often given by human speakers to the normally unstressed words "of", "by" and "for" in the sequence, "government of the people, by the people, for the people". In this example, the contrastive stress pattern applied to the three prepositions, in which each of them may be particularly emphasized, draws the attention of the listener to the differences between them, and to the importance of those differences to the meaning of the sentence.

Contrastive stress can be an important tool in human understanding of meaning as conveyed by spoken language; however, conventional automatic speech synthesis technologies have not taken advantage of contrastive stress as an opportunity to improve intelligibility, naturalness and effectiveness of machine generated speech. Applicants have recognized that a primary focus of many automated information systems is to provide numerical values and other specific datums to users, who in turn often have preconceived expectations about the kind of information they are likely to hear. Information can often be lost in the stream of output audio when a large number of words must be output to collect necessary parameters from the user and to set the context of the system's response. Applicants have appreciated, therefore, that a system that can highlight that although the user expected to hear "this", the actual value is "that", may allow the user to hear and process the information more easily and successfully.

Applicants have further recognized that the process of conventional TTS synthesis is typically not well understood by developers of speech-enabled applications, whose expertise is in designing dialogs for interactive voice response (IVR) applications (for example, delivering flight information or banking assistance) rather than in complex statistical models for mapping acoustical features to phonemes and phonemes to text, for example. In this respect, Applicants have recognized that the use of conventional TTS synthesis to create output speech prompts typically requires speech-enabled application developers to rely on third-party TTS engines for the entire process of converting text input to audio output, requiring that they relinquish control of the type and character of the speech output that is produced.

In accordance with some embodiments of the present invention, techniques are provided that enable the process of speech-enabled application design to be simple while providing naturalness of the speech output and improved emulation of human speech prosody. In particular, some embodiments provide techniques for accepting as input plain text transcriptions of desired speech output, and rendering the text as synthesized speech with contrastive stress. During user interaction with a speech-enabled application, the application may provide to a synthesis system an input text transcription of a desired speech output, and the synthesis system may analyze the text input to determine which portion(s) of the speech output should carry contrastive stress. In some embodiments, the application may include tags in the text input to identify tokens or fields that should contrast with each other, and the synthesis system may analyze those tags to determine which portions of the speech output should carry contrastive stress. In some embodiments, the synthesis system may automatically identify which tokens (e.g., words) should contrast with each other without any tags being included in the text input. From among the tokens that contrast with each other, the synthesis system may further specifically identify which word(s) and/or syllable(s) should carry the contrastive stress. For example, if a plurality of tokens in a text input contrast with each other, one, some or all of those tokens may be stressed when rendering the speech output. In some embodiments, after identifying which word(s) and/or syllable(s) should carry contrastive stress, the synthesis system may apply the contrastive stress to the identified word(s) and/or syllable(s) through increased pitch, amplitude and/or duration, or in any other suitable manner.

The aspects of the present invention described herein can be implemented in any of numerous ways, and are not limited to any particular implementation techniques. Thus, while examples of specific implementation techniques are described below, it should be appreciated that the examples are provided merely for purposes of illustration, and that other implementations are possible.

One illustrative application for the techniques described herein is for use in connection with an interactive voice response (IVR) application, for which speech may be a primary mode of input and output. However, it should be appreciated that aspects of the present invention described herein are not limited in this respect, and may be used with numerous other types of speech-enabled applications other than IVR applications. In this respect, while a speech-enabled application in accordance with embodiments of the present invention may be capable of providing output in the form of synthesized speech, it should be appreciated that a speech-enabled application may also accept and provide any other suitable forms of input and/or output, as aspects of the present invention are not limited in this respect. For instance, some examples of speech-enabled applications may accept user input through a manually controlled device such as a telephone keypad, keyboard, mouse, touch screen or stylus, and provide output to the user through speech. Other examples of speech-enabled applications may provide speech output in certain instances, and other forms of output, such as visual output or non-speech audio output, in other instances. Examples of speech-enabled applications include, but are not limited to, automated call-center applications, internet-based applications, device-based applications, and any other suitable application that is speech enabled.

Figure 2:
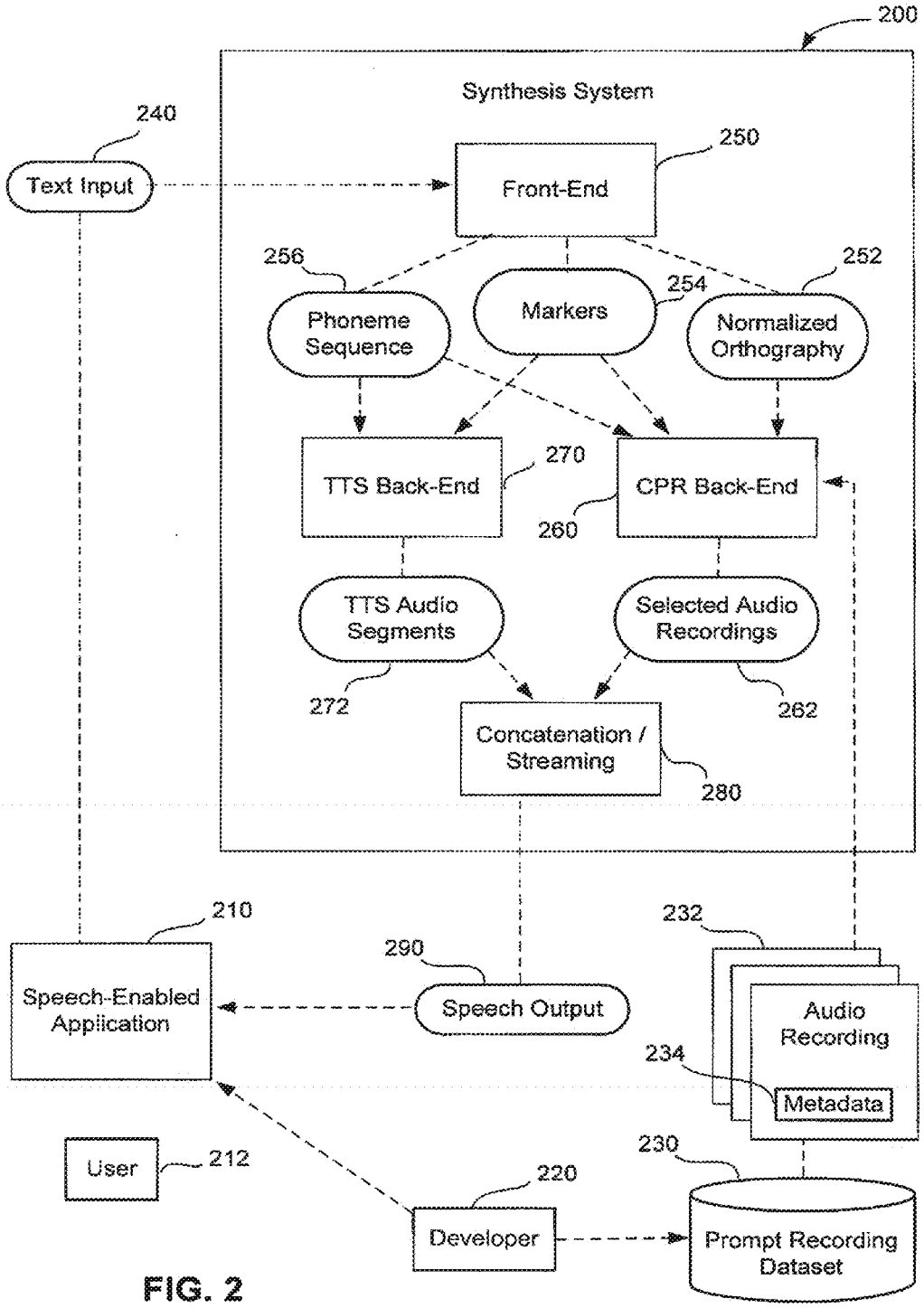
FIG. 2 is a block diagram of an exemplary system for providing speech output for a speech-enabled application, in accordance with some embodiments of the present invention.

An exemplary synthesis system 200 for providing speech output for a speech-enabled application 210 in accordance with some embodiments of the present invention is illustrated in FIG. 2. As discussed above, the speech-enabled application may be any suitable type of application capable of providing output to a user 212 in the form of speech. In accordance with some embodiments of the present invention, the speech-enabled application 210 may be an IVR application; however, it should be appreciated that aspects of the present invention are not limited in this respect.

Synthesis system 200 may receive data from and transmit data to speech-enabled application 210 in any suitable way, as aspects of the present invention are not limited in this respect. For example, in some embodiments, speech-enabled application 210 may access synthesis system 200 through one or more networks such as the Internet. Other suitable forms of network connections include, but are not limited to, local area networks, medium area networks and wide area networks. It should be appreciated that speech-enabled application 210 may communicate with synthesis system 200 through any suitable form of network connection, as aspects of the present invention are not limited in this respect. In other embodiments, speech-enabled application 210 may be directly connected to synthesis system 200 by any suitable communication medium (e.g., through circuitry or wiring), as aspects of the invention are not limited in this respect. It should be appreciated that speech-enabled application 210 and synthesis system 200 may be implemented together in an embedded fashion on the same device or set of devices, or may be implemented in a distributed fashion on separate devices or machines, as aspects of the present invention are not limited in this respect. Each of synthesis system 200 and speech-enabled application 210 may be implemented on one or more computer systems in hardware, software, or a combination of hardware and software, examples of which will be described in further detail below. It should also be appreciated that various components of synthesis system 200 may be implemented together in a single physical system or in a distributed fashion in any suitable combination of multiple physical systems, as aspects of the present invention are not limited in this respect. Similarly, although the block diagram of FIG. 2 illustrates various components in separate blocks, it should be appreciated that one or more components may be integrated in implementation with respect to physical components and/or software programming code.

Speech-enabled application 210 may be developed and programmed at least in part by a developer 220. It should be appreciated that developer 220 may represent a single individual or a collection of individuals, as aspects of the present invention are not limited in this respect. In some embodiments, when speech output is to be synthesized using CPR techniques, developer 220 may supply a prompt recording dataset 230 that includes one or more audio recordings 232. Prompt recording dataset 230 may be implemented in any suitable fashion, including as one or more computer-readable storage media, as aspects of the present invention are not limited in this respect. Data, including audio recordings 232 and/or any metadata 234 associated with audio recordings 232, may be transmitted between prompt recording dataset 230 and synthesis system 200 in any suitable fashion through any suitable form of direct and/or network connection(s), examples of which were discussed above with reference to speech-enabled application 210.

Audio recordings 232 may include recordings of a voice talent (i.e., a human speaker) speaking the words and/or word sequences selected by developer 220 to be used as prompt recordings for providing speech output to speech-enabled application 210. As discussed above, each prompt recording may represent a speech sequence, which may take any suitable form, examples of which include a single word, a prosodic word, a sequence of multiple words, an entire phrase or prosodic phrase, or an entire sentence or sequence of sentences, that will be used in various output speech prompts according to the specific function(s) of speech-enabled application 210. Audio recordings 232, each representing one or more specified prompt recordings (or portions thereof) to be used by synthesis system 200 in providing speech output for speech-enabled application 210, may be pre-recorded during and/or in connection with development of speech-enabled application 210. In this manner, developer 220 may specify and control the content, form and character of audio recordings 232 through knowledge of their intended use in speech-enabled application 210. In this respect, in some embodiments, audio recordings 232 may be specific to speech-enabled application 210. In other embodiments, audio recordings 232 may be specific to a number of speech-enabled applications, or may be more general in nature, as aspects of the present invention are not limited in this respect. Developer 220 may also choose and/or specify filenames for audio recordings 232 in any suitable way according to any suitable criteria, as aspects of the present invention are not limited in this respect.

Audio recordings 232 may be pre-recorded and stored in prompt recording dataset 230 using any suitable technique, as aspects of the present invention are not limited in this respect. For example, audio recordings 232 may be made of the voice talent reading one or more scripts whose text corresponds exactly to the words and/or word sequences specified by developer 220 as prompt recordings for speech-enabled application 210. The recording of the word(s) spoken by the voice talent for each specified prompt recording (or portion thereof) may be stored in a single audio file in prompt recording dataset 230 as an audio recording 232. Audio recordings 232 may be stored as audio files using any suitable technique, as aspects of the present invention are not limited in this respect. An audio recording 232 representing a sequence of contiguous words to be used in speech output for speech-enabled application 210 may include an intact recording of the human voice talent speaker speaking the words consecutively and naturally in a single utterance. In some embodiments, the audio recording 232 may be processed using any suitable technique as desired for storage, reproduction, and/or any other considerations of speech-enabled application 210 and/or synthesis system 200 (e.g., to remove silent pauses and/or misspoken portions of utterances, to mitigate background noise interference, to manipulate volume levels, to compress the recording using an audio codec, etc.), while maintaining the sequence of words desired for the prompt recording as spoken by the voice talent.

Developer 220 may also supply metadata 234 in association with one or more of the audio recordings 232. Metadata 234 may be any data about the audio recording in any suitable form, and may be entered, generated and/or stored using any suitable technique, as aspects of the present invention are not limited in this respect. Metadata 234 may provide an indication of the word sequence represented by a particular audio recording 232. This indication may be provided in any suitable form, including as a normalized orthography of the word sequence, as a set of orthographic variations of the word sequence, or as a phoneme sequence or other sound sequence corresponding to the word sequence, as aspects of the present invention are not limited in this respect. Metadata 234 may also indicate one or more constraints that may be interpreted by synthesis system 200 to limit or express a preference for the circumstances under which each audio recording 232 or group of audio recordings 232 may be selected and used in providing speech output for speech-enabled application 210. For example, metadata 234 associated with a particular audio recording 232 may constrain that audio recording 232 to be used in providing speech output only for a certain type of speech-enabled application 210, only for a certain type of speech output, and/or only in certain positions within the speech output. Metadata 234 associated with some other audio recordings 232 may indicate that those audio recordings may be used in providing speech output for any matching text, for example in the absence of audio recordings with metadata matching more specific constraints associated with the speech output. Metadata 234 may also indicate information about the voice talent speaker who spoke the associated audio recording 232, such as the speaker's gender, age or name. Further examples of metadata 234 and its use by synthesis system 200 are provided below.

In some embodiments, developer 220 may provide multiple pre-recorded audio recordings 232 as different versions of speech output that can be represented by a same textual orthography. In one example, developer 220 may provide multiple audio recordings for different word versions that can be represented by the same orthography, "20". Such audio recordings may include words pronounced as "twenty", "two zero" and "twentieth". Developer 220 may also provide metadata 234 indicating that the first version is to be used when the orthography "20" appears in the context of a natural number, that the second version is to be used in the context of spelled-out digits, and that the third version is to be used in the context of a date. Developer 220 may also provide other audio recording versions of "twenty" with particular inflections, such as an emphatic version, with associated metadata indicating that they should be used in positions of contrastive stress, or preceding an exclamation mark in a text input. It should be appreciated that the foregoing are merely some examples, and any suitable forms of audio recordings 232 and/or metadata 234 may be used, as aspects of the present invention are not limited in this respect.

To accommodate CPR synthesis of speech with contrastive stress, in some embodiments developer 220 (or any other suitable entity) may provide one or more audio recording versions of a word spoken with a particular type of emphasis or stress, meant to contrast it with another word of a similar type or function within the same utterance. For example, developer 220 may provide another audio recording version of the word "twenty" taken from an utterance like, "Not nineteen, but twenty." In such an utterance, the voice talent speaker may have particularly emphasized the number "twenty" to distinguish and contrast it from the other number "nineteen" in the utterance. Such contrastive stress may be a stress or emphasis of a greater degree than would normally be applied to the same word when it is not being distinguished or contrasted with another word of like type, function and/or subject matter. For example, the speaker may apply contrastive stress to the word "twenty" by increasing the target pitch (fundamental frequency), loudness (sound amplitude or energy), and/or length (duration) of the main stressed syllable of the word, or in any other suitable way. In this example, the word "twenty", and specifically its syllable of main lexical stress "twen-", is said to "carry" contrastive stress, by exhibiting an increased pitch, amplitude, and/or duration target during the syllable "twen-". Other voice quality parameters may also be brought into play in human production of contrastive stress, such as amplitude of the glottal voicing source, level of aspiration noise, glottal constriction, open quotient, spectral tilt, level of breathiness, etc.

When providing an audio recording 232 of a word carrying contrastive stress, developer 220 may in some embodiments provide associated metadata 234 that identifies the audio recording 232 as particularly suited for use in rendering a portion of a speech output that is assigned to carry contrastive stress. In some embodiments, metadata 234 may label the audio recording as generally carrying contrastive stress. Alternatively or additionally, metadata 234 may specifically indicate that the audio recording has increased pitch, amplitude, duration, and/or any other suitable parameter, relative to other audio recordings with the same textual orthography. In some embodiments, metadata 234 may even indicate a quantitative measure of the maximum fundamental frequency, amplitude, etc., and/or the duration in units of time, of the audio recording and/or the syllable in the audio recording carrying contrastive stress. Alternatively or additionally, metadata 234 may indicate a quantitative measure of the difference in any of such parameters between the audio recording with contrastive stress and one or more other audio recordings with the same textual orthography. It should be appreciated that metadata 234 may indicate that an audio recording is intended for use in rendering speech to carry contrastive stress in any suitable way, as aspects of the present invention are not limited in this respect.

In accordance with some embodiments of the present invention, prompt recording dataset 230 may be physically or otherwise integrated with synthesis system 200, and synthesis system 200 may provide an interface through which developer 220 may provide audio recordings 232 and associated metadata 234 to prompt recording dataset 230. In accordance with other embodiments, prompt recording dataset 230 and any associated audio recording input interface may be implemented separately from and independently of synthesis system 200. In some embodiments, speech-enabled application 210 may also be configured to provide an interface through which developer 220 may specify templates for text inputs to be generated by speech-enabled application 210. Such templates may be implemented as text input portions to be accordingly fit together by speech-enabled application 210 in response to certain events. In one example, developer 220 may specify a template including a carrier prompt, "Flight number _____ was originally scheduled to depart at _____, but is now scheduled to depart at _____." The template may indicate that content prompts, such as a particular flight number and two particular times of day, should be inserted by the speech-enabled application in the blanks in the carrier prompt to generate a text input to report a change in a flight schedule. The interface may be programmed to receive the input templates and integrate them into the program code of speech-enabled application 210. However, it should be appreciated that developer 220 may provide and/or specify audio recordings, metadata and/or text input templates in any suitable way and in any suitable form, with or without the use of one or more specific user interfaces, as aspects of the present invention are not limited in this respect.

In some embodiments, synthesis system 200 may utilize speech synthesis techniques other than CPR to generate synthetic speech with contrastive stress. For example, synthesis system 200 may employ TTS techniques such as concatenative TTS, formant synthesis, and/or articulatory synthesis, as will be described in detail below, or any other suitable technique. It should be appreciated that synthesis system may apply any of various suitable speech synthesis techniques to the inventive methods of generating synthetic speech with contrastive stress described herein, either individually or in any of various combinations, In this respect, it should be appreciated that one or more components of synthesis system 200 as illustrated in FIG. 2 may be omitted in some embodiments in accordance with the present disclosure. For example, in embodiments in which synthesis system 200 employs only synthesis techniques other than CPR, prompt recording dataset 230 with its audio recordings 232 may not be implemented as part of the system. In other embodiments, prompt recording dataset 230 may be supplied for instances in which it is desired for synthesis system 200 to employ CPR techniques to synthesize some speech outputs, but techniques other than CPR may be employed in other instances to synthesize other speech outputs. In still other embodiments, a combination of CPR and one or more other synthesis techniques may be employed to synthesize various portions of individual speech outputs.

During run-time, which may occur after development of speech-enabled application 210 and/or after developer 220 has provided at least some audio recordings 232 that will be used in speech output in a current session, a user 212 may interact with the running speech-enabled application 210. When program code running as part of the speech-enabled application requires the application to output a speech prompt to user 212, speech-enabled application may generate a text input 240 that includes a literal or word-for-word text transcription of the desired speech output. Speech-enabled application 210 may transmit text input 240 (through any suitable communication technique and medium) to synthesis system 200, where it may be processed. In the embodiment of FIG. 2, the input is first processed by front-end component 250. It should be appreciated, however, that synthesis system 200 may be implemented in any suitable form, including forms in which front-end and back-end components are integrated rather than separate, and in which processing steps may be performed in any suitable order by any suitable component or components, as aspects of the present invention are not limited in this respect.

Front-end 250 may process and/or analyze text input 240 to determine the sequence of words and/or sounds represented by the text, as well as any prosodic information that can be inferred from the text. Examples of prosodic information include, but are not limited to, locations of phrase boundaries, prosodic boundary tones, pitch accents, word-, phrase- and sentence-level stress or emphasis, contrastive stress and the like. In particular, in accordance with some embodiments of the present disclosure, front-end 250 may be programmed to process text input 240 to identify one or more portions of text input 240 that should be rendered with contrastive stress to contrast with one or more other portions of text input 240. Exemplary details of such processing are provided below.

Front-end 250 may be implemented as any suitable combination of hardware and/or software in any suitable form using any suitable technique, as aspects of the present invention are not limited in this respect. In some embodiments, front-end 250 may be programmed to process text input 240 to produce a corresponding normalized orthography 252 and a set of markers 254. Front-end 250 may also be programmed to generate a phoneme sequence 256 corresponding to the text input 240, which may be used by synthesis system 200 in selecting one or more matching audio recordings 232 and/or in synthesizing speech output using one or more forms of TTS synthesis. Numerous techniques for generating a phoneme sequence are known, and any suitable technique may be used, as aspects of the present invention are not limited in this respect.

Normalized orthography 252 may be a spelling out of the desired speech output represented by text input 240 in a normalized (e.g., standardized) representation that may correspond to multiple textual expressions of the same desired speech output. Thus, a same normalized orthography 252 may be created for multiple text input expressions of the same desired speech output to create a textual form of the desired speech output that can more easily be matched to available audio recordings 232. For example, front-end 250 may be programmed to generate normalized orthography 252 by removing capitalizations from text input 240 and converting misspellings or spelling variations to normalized word spellings specified for synthesis system 200. Front-end 250 may also be programmed to expand abbreviations and acronyms into full words and/or word sequences, and to convert numerals, symbols and other meaningful characters to word forms, using appropriate language-specific rules based on the context in which these items occur in text input 240. Numerous other examples of processing steps that may be incorporated in generating a normalized orthography 252 are possible, as the examples provided above are not exhaustive. Techniques for normalizing text are known, and aspects of the present invention are not limited to any particular normalization technique. Furthermore, while normalizing the orthography may provide the advantages discussed above, not all embodiments are limited to generating a normalized orthography 252.

Markers 254 may be implemented in any suitable form, as aspects of the present invention are not limited in this respect. Markers 254 may indicate in any suitable way the locations of various lexical, syntactic and/or prosodic boundaries and/or events that may be inferred from text input 240. For example, markers 254 may indicate the locations of boundaries between words, as determined through tokenization of text input 240 by front-end 250. Markers 254 may also indicate the locations of the beginnings and endings of sentences and/or phrases (syntactic or prosodic), as determined through analysis of the punctuation and/or syntax of text input 240 by front-end 250, as well as any specific punctuation symbols contributing to the analysis. In addition, markers 254 may indicate the locations of peaks in emphasis or contrastive stress, or various other prosodic patterns, as determined through semantic and/or syntactic analysis of text input 240 by front-end 250, and/or as indicated by one or more mark-up tags included in text input 240. Markers 254 may also indicate the locations of words and/or word sequences of particular text normalization types, such as dates, times, currency, addresses, natural numbers, digit sequences and the like. Numerous other examples of useful markers 254 may be used, as aspects of the present invention are not limited in this respect.

Markers 254 generated from text input 240 by front-end 250 may be used by synthesis system 200 in further processing to render text input 240 as speech. For example, markers 254 may indicate the locations of the beginnings and endings of sentences and/or syntactic and/or prosodic phrases within text input 240. In some embodiments, some audio recordings 232 may have associated metadata 234 indicating that they should be selected for portions of a text input at particular positions with respect to sentence and/or phrase boundaries. For example, a comparison of markers 254 with metadata 234 of audio recordings 232 may result in the selection of an audio recording with metadata indicating that it is for phrase-initial use for a portion of text input 240 immediately following a [begin phrase] marker. In a similar example utilizing concatenative TTS synthesis, phoneme audio recordings excised from speech of a voice talent at and/or near the beginning of a phrase may be used to render a portion of text input 240 immediately following a [begin phrase] marker. In examples utilizing articulatory and/or formant synthesis, acoustic and/or articulatory parameters may be manipulated in various ways based on phrase markers, for example to cause the pitch to continuously decrease in rendering a portion of text input 240 leading up to an [end phrase] marker.

In addition, markers 254 may be generated to indicate the locations of pitch accents and other forms of stress and/or emphasis in text input 240, such as portions of text input 240 identified by front-end 250 to be rendered with contrastive stress. In embodiments employing CPR synthesis, markers 254 may be compared with metadata 234 to select audio recordings with appropriate inflections for such locations. When a marker or set of markers is generated to indicate that a word, token or portion of a token from text input 240 is to be rendered to carry contrastive stress, one or more audio recordings with matching metadata may be selected to render that portion of the speech output. As described above, matching metadata may indicate that the selected audio recording is for use in rendering speech carrying contrastive stress, and/or may indicate pitch, amplitude, duration and/or other parameter values and/or characteristics making the selected audio recording appropriate for use in rendering speech carrying contrastive stress. Similarly, in embodiments employing TTS synthesis, parameters such as pitch, amplitude and duration may be appropriately controlled, designated and/or manipulated at the phoneme, syllable and/or word level to render with contrastive stress portions of text input 240 designated by markers 254 as being assigned to carry contrastive stress.

Once normalized orthography 252 and markers 254 have been generated from text input 240 by front-end 250, they may serve as inputs to CPR back-end 260 and/or TTS back-end 270. CPR back-end 260 may also have access to audio recordings 232 in prompt recording dataset 230, in any of various ways as discussed above. CPR back-end 260 may be programmed to compare normalized orthography 252 and markers 254 to the available audio recordings 232 and their associated metadata to select an ordered set of matching selected audio recordings 262. In some embodiments, CPR back-end 260 may also be programmed to compare the text input 240 itself and/or phoneme sequence 256 to the audio recordings 232 and/or their associated metadata 234 to match the desired speech output to available audio recordings 232. In such embodiments, CPR back-end 260 may use text input 240 and/or phoneme sequence 256 in selecting from audio recordings 232 in addition to or in place of normalized orthography 252. As such, it should be appreciated that, although generation and use of normalized orthography 252 may provide the advantages discussed above, in some embodiments any or all of normalized orthography 252 and phoneme sequence 256 may not be generated and/or used in selecting audio recordings.

CPR back-end 260 may be programmed to select appropriate audio recordings 232 to match the desired speech output in any suitable way, as aspects of the present invention are not limited in this respect. For example, in some embodiments CPR back-end 260 may be programmed on a first pass to select the audio recording 232 that matches the longest sequence of contiguous words in the normalized orthography 252, provided that the audio recording's metadata constraints are consistent with the normalized orthography 252, markers 254, and/or any annotations received in connection with text input 240. On subsequent passes, if any portions of normalized orthography 252 have not yet been matched with an audio recording 232, CPR back-end 260 may select the audio recording 232 that matches the longest word sequence in the remaining portions of normalized orthography 252, again subject to metadata constraints. Such an embodiment places a priority on having the largest possible individual audio recording used for any as-yet unmatched text, as a larger recording of a voice talent speaking as much of the desired speech output as possible may provide a most natural sounding speech output. However, not all embodiments are limited in this respect, as other techniques for selecting among audio recordings 232 are possible.

In another illustrative embodiment, CPR back-end 260 may be programmed to perform the entire matching operation in a single pass, for example by selecting from a number of candidate sequences of audio recordings 232 by optimizing a cost function. Such a cost function may be of any suitable form and may be implemented in any suitable way, as aspects of the present invention are not limited in this respect. For example, one possible cost function may favor a candidate sequence of audio recordings 232 that maximizes the average length of all audio recordings 232 in the candidate sequence for rendering the speech output. Optimization of such a cost function may place a priority on selecting a sequence with the largest possible audio recordings on average, rather than selecting the largest possible individual audio recording on each pass through the normalized orthography 252. Another example cost function may favor a candidate sequence of audio recordings 232 that minimizes the number of concatenations required to form a speech output from the candidate sequence. It should be appreciated that any suitable cost function, selection algorithm, and/or prioritization goals may be employed, as aspects of the present invention are not limited in this respect.

However matching audio recordings 232 are selected by CPR back-end 260, the result may be a set of one or more selected audio recordings 262, each selected audio recording in the set corresponding to a portion of normalized orthography 252, and thus to a corresponding portion of the text input 240 and the desired speech output represented by text input 240. The set of selected audio recordings 262 may be ordered with respect to the order of the corresponding portions in the normalized orthography 252 and/or text input 240. In some embodiments, for contiguous selected audio recordings 262 from the set that have no intervening unmatched portions in between, CPR back-end 260 may be programmed to perform a concatenation operation to join the selected audio recordings 262 together end-to-end. In other embodiments, CPR back-end 260 may provide the set of selected audio recordings 262 to a different concatenation/streaming component 280 to perform any required concatenations to produce the speech output. Selected audio recordings 262 may be concatenated using any suitable technique (many of which are known in the art), as aspects of the present invention are not limited in this respect.

Figure 1B:
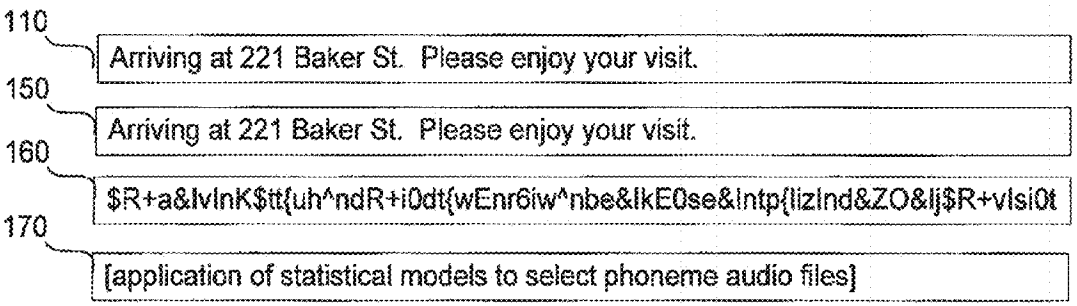
FIG. 1B (Prior Art)
FIG. 1B illustrates an example of conventional text to speech (TTS) synthesis.

If any portion(s) of normalized orthography 252 and/or text input 240 are left unmatched by processing performed by CPR back-end 260 (e.g., if there are one or more portions of normalized orthography 252 for which no matching audio recording 232 is available), synthesis system 200 may in some embodiments be programmed to transmit an error or noncompliance indication to speech-enabled application 210. In other embodiments, synthesis system 200 may be programmed to synthesize those unmatched portions of the speech output using TTS back-end 270. TTS back-end 270 may be implemented in any suitable way. As described above with reference to FIG. 1B, such techniques are known in the art and any suitable technique may be used. TTS back-end 270 may employ, for example, concatenative TTS synthesis, formant TTS synthesis, articulatory TTS synthesis, and/or any other text to speech synthesis technique as is known in the art or as may later be discovered, as aspects of the present invention are not limited in this respect.

In some embodiments, TTS back-end 270 may be used by synthesis system 200 to synthesize entire speech outputs, rather than only portions for which no matching audio recording 232 is available. As discussed above, it should be appreciated that various embodiments according to the present disclosure may employ CPR synthesis and/or TTS synthesis either individually or in any suitable combination. In this respect, some embodiments of synthesis system 200 may omit either CPR back-end 260 or TTS back-end 270, while other embodiments of synthesis system 200 may include both back-ends and may utilize either or both of the back-ends in synthesizing speech outputs.

TTS back-end 270 may receive as input phoneme sequence 256 and markers 254. In some embodiments using concatenative TTS synthesis techniques, statistical models may be used to select a small audio file from a dataset accessible by TTS back-end 270 for each phoneme in the phoneme sequence for the desired speech output. The statistical models may be computed to select an appropriate audio file for each phoneme given the surrounding context of adjacent phonemes given by phoneme sequence 256 and nearby prosodic events and/or boundaries given by markers 254. It should be appreciated, however, that the foregoing is merely an example, and any suitable TTS synthesis technique, including for example articulatory and/or formant synthesis, may be employed by TTS back-end 270, as aspects of the present invention are not limited in this respect. In various embodiments, TTS back-end 270 may be programmed to control synthesis parameters such as pitch, amplitude and/or duration to generate appropriate renderings of phoneme sequence 256 to speech based on markers 254. For instance, TTS back-end 270 may be programmed to synthesize speech output with pitch, fundamental frequency, amplitude and/or duration parameters increased in portions labeled by markers 254 as carrying contrastive stress. TTS back-end 270 may be programmed to increase such parameters for portions carrying contrastive stress, as compared to baseline levels that would be used for those portions of the speech output if they were not carrying contrastive stress.

In some embodiments, when both CPR and TTS synthesis techniques are utilized in various instances by synthesis system 200, a voice talent who recorded generic speech from which phonemes were excised for TTS back-end 270 may also be engaged to record the audio recordings 232 provided by developer 220 in prompt recording dataset 230. In other embodiments, a voice talent may be engaged to record audio recordings 232 who has a similar voice to the voice talent who recorded generic speech for TTS back-end 270 in some respect, such as a similar voice quality, pitch, timbre, accent, speaking rate, spectral attributes, emotional quality, or the like. In this manner, distracting effects due to changes in voice between portions of a desired speech output synthesized using audio recordings 232 and portions synthesized using TTS synthesis may be mitigated.

Selected audio recordings 262 output by CPR back-end 260 and/or TTS audio segments 272 produced by TTS back-end 270 may be input to a concatenation/streaming component 280 to produce speech output 290. Speech output 290 may be a concatenation of selected audio recordings 262 and/or TTS audio segments 272 in an order that corresponds to the desired speech output represented by text input 240. Concatenation/streaming component 280 may produce speech output 290 using any suitable concatenative technique (many of which are known), as aspects of the present invention are not limited in this respect. In some embodiments, such concatenative techniques may involve smoothing processing using any of various suitable techniques as known in the art; however, aspects of the present invention are not limited in this respect. In embodiments and/or instances in which a single audio representation of an entire speech output is provided by a selected audio recording 262 or a TTS audio segment 272, or in which concatenation processes were already performed by CPR back-end 260 or TTS back-end 270, no further concatenation may be necessary, and concatenation/streaming component 280 may simply stream the speech output 290 as received from either back-end.

In some embodiments, concatenation/streaming component 280 may store speech output 290 as a new audio file and provide the audio file to speech-enabled application 210 in any suitable way. In other embodiments, concatenation/streaming component 280 may stream speech output 290 to speech-enabled application 210 concurrently with producing speech output 290, with or without storing data representations of any portion(s) of speech output 290. Concatenation/streaming component 280 of synthesis system 200 may provide speech output 290 to speech-enabled application 210 in any suitable way, as aspects of the present invention are not limited in this respect.

Upon receiving speech output 290 from synthesis system 200, speech-enabled application 210 may play speech output 290 in audible fashion to user 212 as an output speech prompt. Speech-enabled application 210 may cause speech output 290 to be played to user 212 using any suitable technique(s), as aspects of the present invention are not limited in this respect.

Figure 3A:
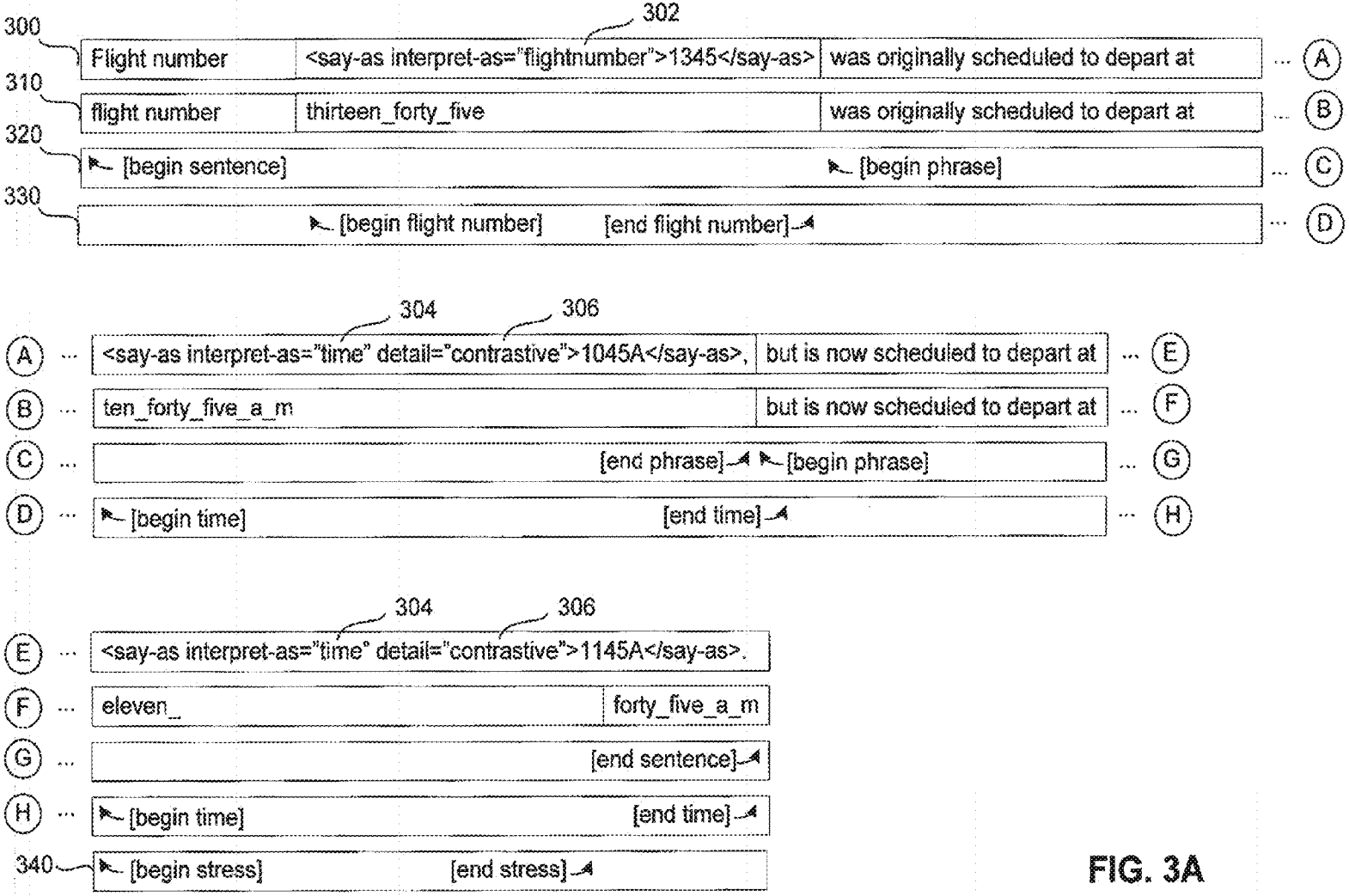
FIGS. 3A and 3B illustrate examples of analysis of text input in accordance with some embodiments of the present invention.
Figure 3B:
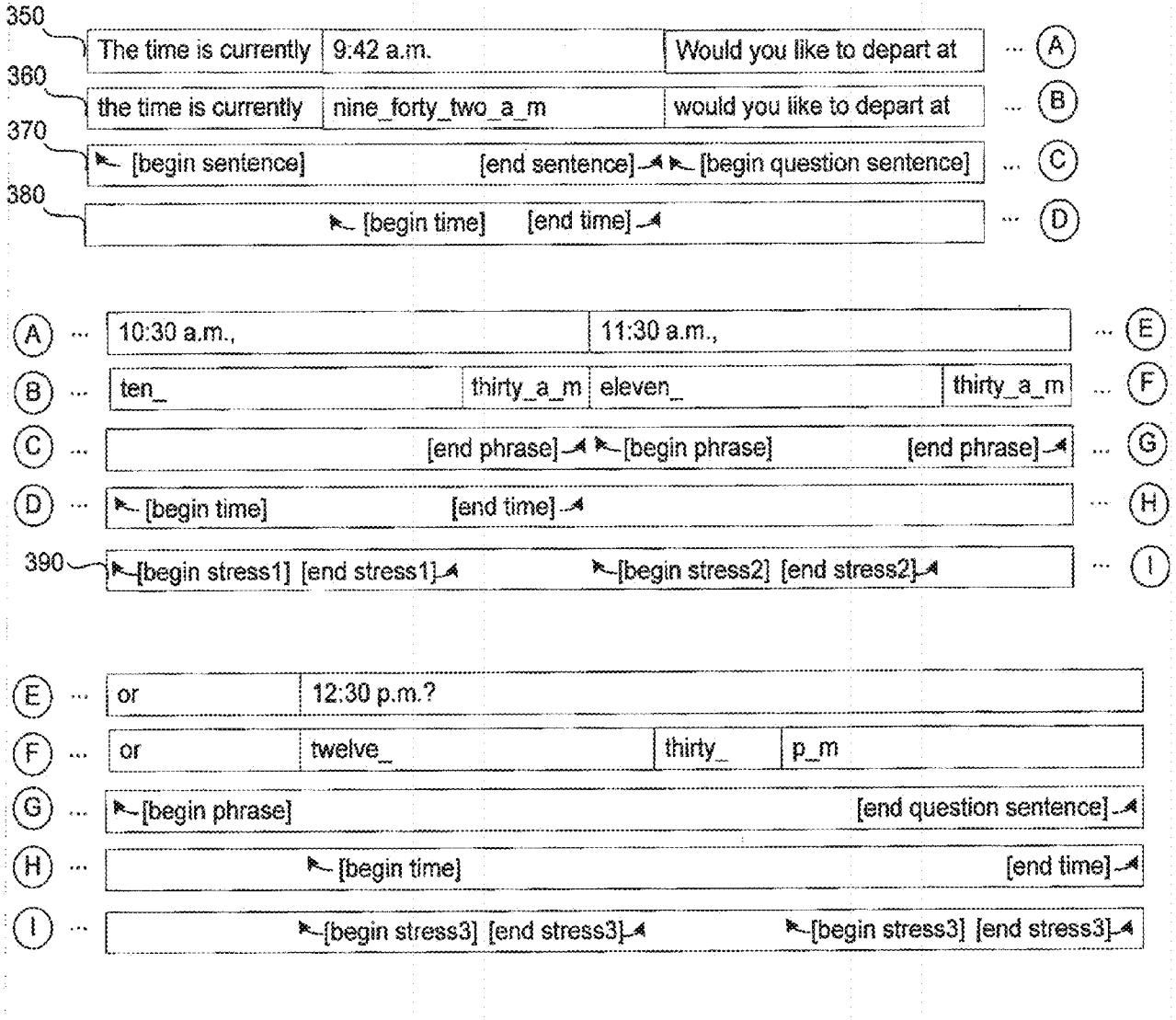

Further description of some functions of a synthesis system (e.g., synthesis system 200) in accordance with some embodiments of the present invention is given with reference to examples illustrated in FIGS. 3A and 3B. FIG. 3A illustrates exemplary processing steps that may be performed by synthesis system 200 in accordance with some embodiments of the present invention to synthesize an illustrative desired speech output, i.e., "Flight number 1345 was originally scheduled to depart at 10:45 a.m., but is now scheduled to depart at 11:45 a.m." Text input 300 is an exemplary text string that speech-enabled application 210 may generate and submit to synthesis system 200, to request that synthesis system 200 provide a synthesized speech output rendering this desired speech output as audio speech. As shown in FIG. 3A, text input 300 is read across the top line of the top portion of FIG. 3A, continuing at label "A" to the top line of the middle portion of FIG. 3A, and continuing further at label "E" to the top line of the bottom portion of FIG. 3A. In some embodiments, text input 300 may include a literal, word-for-word, plain text transcription of the desired speech output, i.e., "Flight number 1345 was originally scheduled to depart at 1045 A, but is now scheduled to depart at 1145 A." As shown, the text transcription may contain such numerical/symbolic notation and/or abbreviations as are normally and often used in transcribing speech in literal fashion to text. In addition, in some embodiments, text input 300 may include one or more annotations or tags added to mark up the text transcription, such as "say-as" tags 302 and 304. Speech-enabled application 210 may generate this text input 300 in accordance with the execution of program code supplied by the developer 220, which may direct speech-enabled application 210 to generate a particular text input 300 corresponding to a particular desired speech output in one or more particular circumstances. It should be appreciated that speech-enabled application 210 may be programmed to generate text inputs for desired speech outputs in any suitable way, as aspects of the present invention are not limited in this respect. Also, speech-enabled application 210 may be programmed to generate a text input in any suitable form that specifies a desired speech output, including forms that do not include annotations or tags and forms that do not include plain text transcriptions, as aspects of the present invention are not limited in this respect.

For the example given in FIG. 3A, speech-enabled application 210 may be an IVR application designed to communicate airline flight information to users, or any other suitable speech-enabled application. For example, a user may place a call over the telephone or through the Internet and interact with speech-enabled application 210 to get status information for a flight of interest to the user. The user may indicate, using speech or another information input method, an interest in obtaining flight status information for flight number 1345. In response to this user input, speech-enabled application 210 may be programmed (e.g., by developer 220) to look up flight departure information for flight 1345 in a table, database or other data set accessible by speech-enabled application 210. If the data returned by this look-up or search indicates that the flight has been delayed, speech-enabled application 210 may be programmed to access a certain carrier prompt, e.g., "Flight number _____ was originally scheduled to depart at _____, but is now scheduled to depart at _____." Speech-enabled application 210 may be programmed to enter the flight number requested by the user (e.g., "1345") in the first blank field of the carrier prompt, the original time of departure returned from the data look-up (e.g., "1045 A") in the second blank field of the carrier prompt, and the new time of departure returned from the data look-up (e.g., "1145 A") in the third blank field of the carrier prompt.

FIG. 3A illustrates one example of a text input 300 that may be generated by an exemplary speech-enabled application 210 in accordance with its programming by a developer 220. In particular, FIG. 3A provides an example text input 300 that may be generated by speech-enabled application 210 and transmitted to synthesis system 200 to be rendered as speech with an appropriately applied pattern of contrastive stress. It should be appreciated that numerous and varied other examples of text inputs, corresponding to numerous and varied other desired speech outputs, may be generated by airline flight information applications or speech-enabled applications in numerous other contexts, for use in synthesizing speech with contrastive stress, as aspects of the present invention are not limited to any particular examples of desired speech outputs, text inputs, or application domains. Any suitable speech-enabled application 210 may be programmed by a developer 220 to generate any suitable text input in any suitable way, e.g., through simple and easy-to-implement programming code based on the plain text of carrier prompts and content prompts to be combined to form a complete desired speech output, or in other ways.

Accordingly, developer 220 may develop speech-enabled application 210 in part by entering plain text transcription representations of desired speech outputs into the program code of speech-enabled application 210. As shown in FIGS. 3A and 3B, such plain text transcription representations may contain such characters, numerals, and/or other symbols as necessary and/or preferred to transcribe desired speech outputs to text in a literal manner. Developer 220 may also enter program code to direct speech-enabled application 210 to add one or more annotations or tags to mark up one or more portions of the plain text transcription. It should be appreciated, however, that speech-enabled application 210 may be developed in any suitable way and may represent desired speech outputs in any suitable form, including forms without annotations, tags or plain text transcription, as aspects of the present invention are not limited in this respect.

In some embodiments, synthesis system 200 may be programmed and/or configured to analyze text input 300 and appropriately render text input 300 as speech, without requiring the input to specify the filenames of appropriate audio recordings for use in the synthesis, or any filename mapping function calls to be hard coded into speech-enabled application 210 and the text input it generates. In embodiments employing CPR synthesis, synthesis system 200 may select audio recordings 232 from the prompt recording dataset 230 provided by developer 220, and may make selections in accordance with constraints indicated by metadata 234 provided by developer 220. Developer 220 may thus retain a measure of deterministic control over the particular audio recordings used to synthesize any desired speech output, while also enjoying ease of programming, debugging and/or updating speech-enabled application 210 at least in part using plain text. In some embodiments, developer 220 may be free to directly specify a filename for a particular audio recording to be used should an occasion warrant such direct specification; however, developer 220 may be free to also choose plain text representations at any time. In embodiments employing only TTS synthesis, developer 220 may also use plain text representations of desired speech output for synthesis, without need for supplying audio recordings 232.

In some embodiments, developer 220 may program speech-enabled application 210 to include with text input 300 one or more annotations, or tags, to constrain the audio recordings 232 that may be used to render various portions of text input 300, or to similarly constrain the output of TTS synthesis of text input 300. For example, text input 300 includes an annotation 302 indicating that the number "1345" should be interpreted and rendered in speech as appropriate for a flight number. In this example, annotation 302 is implemented in the form of a World Wide Web Consortium Speech Synthesis Markup Language (W3C SSML) "say-as" tag, with an "interpret-as" attribute whose value is "flightnumber". Here, "flightnumber" is referred to as the "say-as" type, or "text normalization type", of the number "1345" in this text input. SSML tags are an example of a known type of annotation that may be used in accordance with some embodiments of the present invention. However, it should be appreciated that any suitable form of annotation may be employed to indicate a desired type (e.g., a text normalization type) of one or more words in a desired speech output, as aspects of the present invention are not limited in this respect.

Upon receiving text input 300 from speech-enabled application 210, synthesis system 200 may process text input 300 through front-end 250 to generate normalized orthography 310 and markers 320, 330 and 340. Normalized orthography 310 is read across the second line of the top portion of FIG. 3A, continuing at label "B" to the second line of the middle portion of FIG. 3A, and continuing further at label "F" to the second line of the bottom portion of FIG. 3A. Sentence/phrase markers 320 are read across the third line of the top portion of FIG. 3A, continuing at label "C" to the third line of the middle portion of FIG. 3A, and continuing further at label "G" to the third line of the bottom portion of FIG. 3A. Text normalization type markers 330 are read across the fourth line of the top portion of FIG. 3A, continuing at label "D" to the fourth line of the middle portion of FIG. 3A, and continuing further at label "H" to the fourth line of the bottom portion of FIG. 3A. Stress markers 340 are read across the bottom line of the bottom portion of FIG. 3A.

As discussed above with reference to FIG. 2, normalized orthography 310 may represent a conversion of text input 300 to a standard format for use by synthesis system 200 in subsequent processing steps. For example, normalized orthography 310 represents the word sequence of text input 300 with capitalizations, punctuation and annotations removed. In addition, the numerals "1345" in text input 300 are converted to the word forms "thirteen_forty_five" in normalized orthography 310, the time "1045 A" in text input 300 is converted to the word forms "ten_forty_five_a_m" in normalized orthography 310, and the time "1145 A" in text input 300 is converted to the word forms "eleven_forty_five_a_m" in normalized orthography 310.

In converting the numerals "1345", for example, to word forms, synthesis system 200 may make note of annotation 302 and render the numerals in appropriate word forms for a flight number, in accordance with its programming. Thus, for example, synthesis system 200 may be programmed to convert numerals "1345" with text normalization type "flightnumber" to the word form "thirteen_forty_five" rather than "one_thousand_three_hundred_forty_five", the latter perhaps being more appropriate for other contexts (e.g., numerals with text normalization type "currency"). If an annotation is not provided for one or more numerals, words or other character sequences in text input 300, in some embodiments the synthesis system 200 may attempt to infer a type of the corresponding words in the desired speech output from the semantic and/or syntactic context in which they occur. For example, in text input 300, the numerals "1345" may be inferred to correspond to a flight number because they are preceded by the words "Flight number". It should be appreciated that types of words or tokens (e.g., text normalization types) in a text input may be determined using any suitable techniques from any information that may be explicitly provided in the text input, including associated annotations, or may be inferred from the content of the text input, as aspects of the present invention are not limited in this respect.

Although certain indications such as capitalization, punctuation and annotations may be removed from normalized orthography 310, syntactic, prosodic and/or word type information represented by such indications may be conveyed through markers 320, 330 and 340. For example, sentence/phrase markers 320 include [begin sentence] and [end sentence] markers that may be derived from the capitalization of the initial word "Flight" and the period punctuation mark in text input 300. Sentence/phrase markers 320 also include [begin phrase] and [end phrase] markers that may be derived in part from the comma punctuation mark following "1045 A", and in part from other syntactic considerations. In addition, text normalization type markers 330 include [begin flight number] and [end flight number] markers derived from "say-as" tag 302, as well as [begin time] and [end time] markers derived from "say-as" tags 304. Although not shown in FIG. 3A, examples of other markers that may be generated are markers that indicate the locations of boundaries between words, which may be useful in generating normalized orthography 310 (e.g., with correctly delineated words), selecting audio recordings (e.g., from input text 300, normalized orthography 310 and/or a generated phoneme sequence with correctly delineated words), and/or generating any appropriate TTS audio segments, as discussed above.

In addition, various markers may indicate the locations of prosodic boundaries and/or events, such as locations of phrase boundaries, prosodic boundary tones, pitch accents, word-, phrase- and sentence-level stress or emphasis, and the like. The locations and labels for such markers may be determined, for example, from punctuation marks, annotations, syntactic sentence structure and/or semantic analysis. As a particular example, synthesis system 200 may generate stress markers 340 to delineate one or more portions of text input 300 and/or normalized orthography 310 that have been identified by synthesis system 200 as portions to be rendered to carry contrastive stress.

In the example of FIG. 3A, the [begin stress] and [end stress] markers 340 delineate the word "eleven" within the time "11:45 a.m." as the specific portion of the speech output that should carry contrastive stress. In this example, "11:45 a.m.", the new time of the flight departure, contrasts with "10:45 a.m.", the original time of the flight departure. Specifically, "eleven" is the part of "11:45 a.m." that differs from and contrasts with the "ten" of "10:45 a.m." (i.e., the "forty_five" and the "a.m." do not differ or contrast). By carrying contrastive stress specifically on the word "eleven" (more particularly, on the syllable "-lev-", which is the syllable of main lexical stress in the word "eleven"), the resulting synthetic speech output may draw a listener's focus to the contrasting part of the sentence, and cause the listener to pay attention to the important difference between the "ten" of the original time and the "eleven" of the new time. (In some examples, contrastive stress in speech may be regarded as an aural equivalent to placing visual emphasis on portions of text, e.g., "Flight number 1345 was originally scheduled to depart at ten forty-five a.m., but is now scheduled to depart at eleven forty-five a.m.") Rendering the synthetic speech output with the appropriate contrastive stress may also cause the speech output to sound more natural and more like human speech, making listeners/users more comfortable with using the speech-enabled application.

Synthesis system 200 may be programmed to identify one or more specific portions of text input 300 and/or normalized orthography 310 to be assigned to carry contrastive stress, and to delineate those portions with markers 340, thereby assigning them to carry contrastive stress, using any suitable technique, which may vary depending on the form and/or content of text input 300. In some embodiments, speech-enabled application 210 may be programmed (e.g., by developer 220) to mark-up text input 300 with annotations or tags that label two or more fields of the text input for which a contrastive stress pattern is desired. In one example, as illustrated in FIG. 3A, speech-enabled application 210 may be programmed to indicate a desired contrastive stress pattern using the "detail" attribute 306 of an SSML "say-as" tag. By setting the "detail" attribute of a plurality of tagged fields of the same text normalization type to "contrastive", speech-enabled application 210 may indicate to synthesis system 200 that it is desired for those fields to contrast with each other through a contrastive stress pattern. It should be appreciated that use of such a "contrastive" tag may provide additional capabilities not offered by existing annotations such as, for example, the SSML <emphasis> tag; whereas the <emphasis> tag allows only for specification of a generic emphasis level to be applied to a single isolated field, a "contrastive" tag in accordance with some embodiments of the present invention may allow for indication of a desired contrastive stress pattern to be applied in the context of two or more fields of the same text normalization type, with the level of emphasis to be assigned to portions of each field to be determined by an appropriate contrastive stress pattern applied to those fields in combination. In the example of FIG. 3A, the two fields "1045 A" and "1145 A" are tagged with the same text normalization type "time" and the detail attribute value "contrastive", indicating that the two times should be contrasted with each other. It should be appreciated that "detail" attributes and SSML "say-as" tags are only one example of annotations that may be used by speech-enabled application to label text fields for which contrastive stress patterns are desired, and any suitable annotation technique may be used, as aspects of the present invention are not limited in this respect.

By applying a contrastive stress pattern to two or more fields in a text input of the same text normalization type, synthesis system 200 may achieve an accurate imitation of a particular set of known patterns in human prosody. As discussed above, humans apply some forms of contrastive stress to draw attention and focus to the differences between syllables, words or word sequences of similar type and/or function that are meant to contrast in an utterance. In the example of FIG. 3A, "1045 A" and "1145 A" are both times of day; moreover, they are both times of departure associated with the same flight, flight number 1345. 10:45 a.m. was the original time of departure and 11:45 a.m. is the new time of departure; thus, in a defined sense, the two times are alternatives to each other. The difference between the two times is important information to highlight to the user/listener, who may benefit from having his/her attention drawn to the fact that an original time is being updated to a new time. By confirming that the two fields of text input 300 that are tagged as "contrastive" are of the same text normalization type (e.g., "time"), synthesis system 200 may determine that this type of contrastive stress pattern is appropriate.

Identification of the text normalization type of fields tagged as "contrastive" may in some embodiments aid synthesis system 200 in identifying portions of a text input that are meant to contrast with each other, as well as the relationships between such portions. For instance, another example desired speech output could be, "Flight number 1345, originally scheduled to depart at 10:45 a.m., has been changed to flight number 13<u>67</u>, now scheduled to depart at <u>11</u>:45 a.m." An example text input generated by speech-enabled application 210 for this example desired speech output could be: "Flight number <say-as interpret-as="flightnumber" detail="contrastive">1345</say-as>, originally scheduled to depart at <say-as interpret-as="time" detail="contrastive">1045 A</say-as>, has been changed to flight number <say-as interpret-as="flightnumber" detail="contrastive">1367</say-as>, now scheduled to depart at <say-as interpret-as="time" detail="contrastive">1145 A</say-as>." Although all four fields, "1345", "1045 A", "1367" and "1145 A", are tagged as "contrastive", it would be clear to a human speaker that not all four fields should contrast with each other. Rather, the flight numbers "1345" and "1367" contrast with each other, and the times "10:45 a.m." and "11:45 a.m." contrast with each other. Thus, by identifying fields tagged with the same text normalization type in addition to the "contrastive" detail attribute, synthesis system 200 may appropriately apply one contrastive stress pattern to the flight numbers "1345" and "1367" and a separate contrastive stress pattern to the times "1045 A" and "1145 A"

Examples of text normalization types of text input fields to which synthesis system 200 may apply contrastive stress patterns include, but are not limited to, alphanumeric sequence, address, Boolean value (true or false), currency, date, digit sequence, fractional number, proper name, number, ordinal number, telephone number, flight number, state name, street name, street number, time and zipcode types. It should be appreciated that, although many examples of text normalization types involve numeric data, other examples are directed to non-numeric fields (e.g., names, or any other suitable fields of textual information) that may also be contrasted with each other in accordance with some embodiments of the present invention. It should also be appreciated that any suitable text normalization type(s) may be utilized by speech-enabled application 210 and/or synthesis system 200, as aspects of the present invention are not limited in this respect.

If at any time synthesis system 200 receives a text input with a field tagged as to "contrastive" that is not of the same text normalization type as any other field within the text input, in some embodiments synthesis system 200 may be programmed to ignore the "contrastive" tag and render that portion of the speech output without contrastive stress. Alternatively, if synthesis system 200 can infer through analysis of the format and/or syntax of the portion of the text input labeled by the tag that the labeled text normalization type is obviously in error, synthesis system 200 may substitute a more appropriate text normalization type that matches that of another field labeled "contrastive". In some embodiments, synthesis system 200 may be programmed to return an error or warning message to speech-enabled application 210, indicating that "contrastive" tags apply only to a plurality of fields of the same text normalization type. However, in some embodiments, synthesis system 200 may be programmed to apply a contrastive stress pattern to any fields tagged as "contrastive", regardless of whether they are of the same text normalization type, following processing steps similar to those described below for fields of matching text normalization types. Also, in some embodiments, synthesis system 200 may apply a pattern of contrastive stress without reference to any text normalization tags at all, as aspects of the present invention are not limited in this respect.

In some embodiments, synthesis system 200 may be programmed with a number of contrastive stress patterns from which it may select and apply to portions of a text input in accordance with various criteria. Returning to the example of FIG. 3A, synthesis system 200 may identify "1045 A" and "1145 A" as two fields of text input 300 for which a contrastive stress pattern is desired in any suitable way, e.g., by determining that they are both tagged as the same text normalization type and both tagged as "contrastive". In some embodiments, synthesis system 200 may be programmed to render both of the two fields with contrastive stress, since they are both tagged as "contrastive". In some other embodiments, synthesis system 200 may be programmed to apply a contrastive stress pattern in which only the second of two contrasting fields (i.e., "1145 A") is rendered with stress. In yet other embodiments, synthesis system 200 may be programmed to render both of two contrasting fields with contrastive stress in some situations, and to render only one or the other of two contrasting fields with contrastive stress in other situations, according to various criteria. In some embodiments, synthesis system 200 may be programmed to render both fields with contrastive stress, but to apply a different level of stress to each field, as will be discussed below. For example, in some embodiments synthesis system 200 may be programmed to generate the output, "Flight number 1345 was originally scheduled to depart at 10:45 a.m., but is now scheduled to depart at 11:45 a.m.," with the "10:45 a.m." rendered with anticipatory contrastive stress of the same or a different level as the stress applied to "11:45 a.m." In some embodiments, speech-enabled application 210 may be programmed to include one or more annotations in text input 300 to indicate which particular contrastive stress pattern is desired and/or what specific levels of stress are desired in association with individual contrasting fields. It should be appreciated, however, that the foregoing are merely examples, and particular contrastive stress patterns may be indicated and/or selected in any suitable way according to any suitable criteria, as aspects of the present invention are not limited in this respect.

In some embodiments, synthesis system 200 may select an appropriate contrastive stress pattern for a plurality of contrasting fields based at least in part on the presence and type of one or more linking words and/or word sequences that indicate an appropriate contrastive stress pattern. In the example of FIG. 3A, synthesis system 200 may be programmed to recognize the words/word sequences "originally", "but" and "is now" as linking words/word sequences (or equivalently, tokens/token sequences) associated either individually or in combination with one or more contrastive stress patterns. In some embodiments, a pattern of two contrasting fields of the same normalization type, in certain combinations with one or more linking tokens such as "originally", "but" and "is now", may indicate to synthesis system 200 that the two fields do indeed contrast, and that contrastive stress is appropriate. Such an indication may bolster the separate indication given by the "contrastive" tag, and/or may be used by synthesis system 200 instead of referring to the "contrastive" tag, both for text inputs that contain such tags and for text inputs that do not.

In some embodiments, the particular linking tokens identified by synthesis system 200 and their syntactic relationships to the contrasting fields may be used by synthesis system 200 to select a particular contrastive stress pattern to apply to the fields. For instance, in the example of FIG. 3A, synthesis system 200 may select a contrastive stress pattern in which only the second time, "11:45 a.m.", is rendered with contrastive stress, based on the fact that the linking token "originally" precedes the time "1045 A" in the same clause and the linking tokens "but is now" precede the time "1145 A" in the same clause, indicating that "11:45 a.m." is the new time that should be emphasized to distinguish it from the original time. However, the foregoing is merely one example; in other embodiments, synthesis system 200 may associate the same syntactic structure between the linking tokens and contrasting fields with a different contrastive stress pattern, such as one in which both fields are rendered with contrastive stress (i.e., incorporating anticipatory stress on the first field), in accordance with its programming. It should be appreciated that synthesis system 200 may be programmed to associate linking tokens and relationships between linking tokens and contrasting fields in text inputs in any suitable way, and in some embodiments synthesis system 200 may be programmed to select contrastive stress patterns and identify fields to be rendered with contrastive stress without any reference to linking tokens, as aspects of the present invention are not limited in this respect.

Examples of linking tokens/token sequences that may be identified by synthesis system 200 and used by synthesis system 200 in identifying fields and/or tokens to be rendered with contrastive stress include, but are not limited to, "originally", "but", "is now", "or", "and", "whereas", "as opposed to", "as compared with", "as contrasted with" and "versus". Translations of such linking tokens into other languages, and/or other linking tokens unique to other languages, may also be used in some embodiments. It should be appreciated that synthesis system 200 may be programmed to utilize any suitable list of any suitable number of linking tokens/token sequences, including no linking tokens at all in some embodiments, as aspects of the present invention are not limited in this respect. In some embodiments, fields and/or tokens to be rendered with contrastive stress may also or alternatively be identified based on part-of-speech sequences that establish a repeated pattern with one element different. Some exemplary patterns are as follows:

"the <adjective> <nounphrase> is <value>: the <different adjective> <same nounphrase> is <different value>". Example: "the red smoking jacket is $42; the blue smoking jacket is $52".

"<any three words> <value of a certain type>; <up to 'n' words that do not include a value of any type> <two of the three words with a different word of the same part of speech> <different value of the same type>". Examples: "Out of all my favorite vacations, I guess I'd rate skiing in Aspen 4 stars, but if you really want something extraordinary, I'd go with skiing in Vail: 5 stars." "Out of all my favorite vacations, I guess I'd rate skiing in Aspen 4 stars, but if you really want something extraordinary, I'd go with bowling in Aspen: 5 stars."

In some embodiments, developer 220 may be informed of the list of linking tokens/token sequences that can be recognized by synthesis system 200, and/or may be informed of the particular mappings of syntactic patterns of linking tokens and contrasting fields to particular contrastive stress patterns utilized by synthesis system 200. In such embodiments, developer 220 may program speech-enabled application 210 to generate text input with carrier prompts using the same linking tokens and syntactic patterns to achieve a desired contrastive speech pattern in the resulting synthetic speech output. In other embodiments, developer 220 may provide his own list to synthesis system 200 with linking tokens/token sequences and/or syntactic patterns involving linking tokens, and synthesis system 200 may be programmed to utilize the developer-specified linking tokens and/or pattern mappings in identifying fields or tokens to be rendered with contrastive stress and/or in selecting contrastive stress patterns. In yet other embodiments, a list of linking tokens and/or syntactic patterns of synthesis system 200 may be combined with a list supplied by developer 220. It should be appreciated that developer 220, speech-enabled application 210 and synthesis system 200 may coordinate linking tokens and/or linking token syntactic pattern mappings in any suitable way using any suitable technique(s), as aspects of the present invention are not limited in this respect.

In some embodiments, once synthesis system 200 has identified a plurality of fields of the text input to which a contrastive stress pattern should be applied (e.g., based on tags included in the text input as generated by speech-enabled application 210) and has identified one or more particular ones of those fields to be rendered with contrastive stress (e.g., by selecting and applying a particular contrastive stress pattern), synthesis system 200 may further identify the specific portion(s) of those field(s) to be rendered to actually carry the contrastive stress. That is, synthesis system 200 may identify which particular word(s) and/or syllable(s) will carry contrastive stress in the synthetic speech output through increased pitch, amplitude, duration, etc., based on an identification of the salient differences between the contrasting fields.

As described above, in the example of FIG. 3A, in some embodiments synthesis system 200 may identify "1045 A" and "1145 A" as two fields of text input 300 for which a contrastive stress pattern is desired, based on "contrastive" tags 306. Further, in some illustrative embodiments, synthesis system 200 may identify "1145 A" as the specific field to be rendered with contrastive stress, because it is second in the order of the contrasting fields, because of a syntactic pattern involving linking tokens, or in any other suitable way. It should be appreciated from the foregoing, however, that synthesis system 200 may also in some embodiments be programmed to identify "1045 A" as a field to be rendered with contrastive stress, at the same or a different level of emphasis as "1145 A". In some embodiments, the entire token "1145 A" may be identified to carry contrastive stress, while in other embodiments synthesis system 200 may next proceed to identify only one or more specific portions of the field "1145 A" to be rendered to carry contrastive stress. As discussed above, the portion that should be stressed contrastively in this example is the word "eleven", and specifically the syllable of main lexical stress "-lev-" in the word "eleven", since "eleven" is the portion of the time "11:45 a.m." that differs from the other time "10:45 a.m."

In some embodiments, synthesis system 200 may identify the specific sub-portion(s) of one or more fields or tokens that should carry contrastive stress by comparing the normalized orthography of the field(s) or token(s) identified to be rendered with contrastive stress to the normalized orthography of the other contrasting field(s) or token(s), and determining which specific portion or portions differ. In some situations, an entire field may differ from another field with which it contrasts (e.g., as "10:45" differs from "8:30"). In such situations, synthesis system 200 may be programmed in some embodiments to assign all word portions within the field to carry contrastive stress. In some embodiments, the level of stress assigned to a field or token that differs entirely from another field or token with which it contrasts may be lower than that assigned to fields or tokens for which only one or more portions differ. Because the differences between fields that differ entirely from each other may already be more salient to a listener without need for much contrastive stress, in some embodiments synthesis system 200 may be programmed to assign only light emphasis to such a field, or to not assign any emphasis to the field at all. However, it should be appreciated that the foregoing are merely examples, and synthesis system 200 may be programmed to apply any suitable contrastive stress pattern to contrasting fields that differ entirely from each other, including patterns with levels of emphasis similar to those of patterns applied to fields in which only portions differ, as aspects of the present invention are not limited in this respect.

However, in the example of FIG. 3A, synthesis system 200 may compare the normalized orthography "eleven_forty_five_a_m" to the normalized orthography "ten_forty_five_a_m_" to determine that "eleven" is the portion that differs. As a result, synthesis system 200 may assign the word "eleven" to carry contrastive stress. This may be done in any suitable way. For example, by looking up the word "eleven" in a dictionary, database, table or other lexical stress data set accessible to synthesis system 200, synthesis system 200 may determine that "-lev-" is the syllable of main lexical stress of the word "eleven", and may assign the syllable "-lev-" to carry contrastive stress through increased pitch, amplitude and/or duration targets.

It should be appreciated that synthesis system 200 may determine a particular syllable of main stress within a word assigned to carry contrastive stress in any suitable way using any suitable technique, as aspects of the present invention are not limited in this respect. In some embodiments, particularly those using CPR synthesis, synthesis system 200 may not identify a specific syllable to carry contrastive stress at all, but may simply assign an entire word (regardless of how many syllables it contains) to carry contrastive stress. An audio recording with appropriate metadata labeling it for use in rendering the word with contrastive stress may then be used to synthesize the entire word, without need for identifying a specific syllable that carries the stress. In some embodiments, however, situations may arise in which synthesis system 200 identifies a particular syllable to be rendered to carry contrastive stress, independent of which is the syllable of main lexical stress in any dictionary. For example, synthesis system 200 may identify a different syllable to carry stress in the word "nineteen" when it is being contrasted with the word "eighteen" (i.e., when the first syllable differs) than when it is being contrasted with the word "ninety" (i.e., when the second syllable differs).

Identifying specific portions of one or more fields or tokens to be rendered to carry contrastive stress through a comparison of normalized orthography in some embodiments may provide the advantage that the portions that differ can be readily identified in terms of their spoken word forms as they will be rendered in the speech output. In the example text input 300 of FIG. 3A, "1045 A" and "1145 A" textually differ only in one digit (i.e., the "0" of "1045 A" differs from the "1" of "1145 A"). However, the portions of the speech output that contrast are actually "ten" and "eleven", not "zero" and "one". This is readily apparent from a comparison of the normalized orthographies "ten_forty_five_a_m" and "eleven_forty_five_a_m", and synthesis system 200 may in some embodiments identify the portion "eleven" to carry contrastive stress directly from the normalized orthography representation 310 of the text input. However, it should be appreciated that not all embodiments are limited to comparison of normalized orthographies. For example, in some embodiments, synthesis system 200 may be programmed to identify differing portions of contrasting fields directly from phoneme sequence 256 and/or text input 300, using rules specific to particular text normalization types. For text input fields of the form "1045 A" and "1145 A" with text normalization type "time", synthesis system 200 may be programmed to compare the first two digits separately as one word, the second two digits separately as one word, and the final letter separately as denoting specifically "a.m." or "p.m.", for example. It should be appreciated that synthesis system 200 may be programmed to identify portions of contrasting fields or tokens that differ using various different techniques in various embodiments, as aspects of the present invention are not limited to any particular technique in this respect.

Having identified one or more specific portions (e.g., words or syllables) within normalized orthography 310 and/or text input 300 to be rendered to carry contrastive stress, synthesis system 200 may generate stress markers 340 to delineate and label those portions for further synthesis processing. In the example of FIG. 3A, stress markers 340 include [begin stress] and [end stress] markers that mark the word "eleven" as assigned to carry contrastive stress. In subsequent stages of processing in embodiments using CPR synthesis, stress markers 340 may be compared with metadata 234 of audio recordings 232 to select one or more audio recordings labeled as appropriate for use in rendering the word "eleven" as speech carrying contrastive stress. As discussed above, a matching audio recording may in some embodiments simply be labeled by metadata as "emphasized", "contrastive" or the like. In other embodiments, metadata associated with a matching audio recording may indicate specific information about the pitch, to fundamental frequency, amplitude, duration and/or other voice quality parameters involved in the production of contrastive stress, examples of which were given above.

In some embodiments using concatenative TTS synthesis, metadata associated with individual phoneme (or phone, allophone, diphone, syllable, etc.) audio recordings may also be compared with stress markers 340 in synthesizing the delineated portion of text input 300 and/or normalized orthography 310 as speech carrying contrastive stress. Similar to metadata 234 associated with audio recordings 232, metadata associated with phoneme recordings may also indicate that the recorded phoneme is "emphasized", or may indicate qualitative and/or quantitative information about pitch, fundamental frequency, amplitude, duration, etc. In concatenative TTS synthesis, a parameter (e.g., fundamental frequency, amplitude, duration) target may be set by synthesis system 200 for a particular phoneme within the word carrying contrastive stress, e.g., for the vowel of the syllable of main lexical stress. Contours for each of the parameters may then be set over the course of the other phonemes being concatenated to form the word, with the contrastive stress target phoneme exhibiting a local maximum in the selected parameter(s), and the other concatenated phonemes having parameter values increasing up to and decreasing down from that local maximum. It should be appreciated, however, that the foregoing description is merely exemplary, and any suitable technique(s) may be used to implement contrastive stress in concatenative TTS synthesis, as aspects of the present invention are not limited in this respect.

Similarly, in embodiments using non-concatenative synthesis techniques such as articulatory or formant synthesis, synthesis parameter contours may be generated by synthesis system 200, such that a local maximum occurs during the syllable carrying contrastive stress in one or more appropriate parameters such as fundamental frequency, amplitude, duration, and/or others as described above. Audio speech output may then be generated using these synthesis parameter contours. In some embodiments, in specifying synthesis parameter contours for generating the speech output as a whole, synthesis system 200 may be programmed to make one or more other portions of the speech output prosodically compatible with the one or more portions carrying contrastive stress. For instance, in the example of FIG. 3A, if a local maximum in fundamental frequency (related to pitch) is set to occur during the word "eleven" carrying contrastive stress, the fundamental frequency contour during the portion of the speech output leading up to the word "eleven" (i.e., during the words "depart at", or other surrounding words) may be set to an increasing slope that meets up with the increased contour during "eleven" such that no discontinuities result in the overall contour. Synthesis system 200 may be programmed to generate such parameter contours in any form of TTS synthesis in a way that emulates human prosody in utterances with contrastive stress. It should be appreciated that the foregoing description is merely exemplary, and any suitable technique(s) may be used to implement contrastive stress in TTS synthesis, as aspects of the present invention are not limited in this respect.

In CPR synthesis, audio recordings 232 selected to render portions of the speech output other than those carrying contrastive stress may also be selected to be prosodically compatible with those rendering portions carrying contrastive stress. Such selection may be made by synthesis system 200 in accordance with metadata 234 associated with audio recordings 232. In the example of FIG. 3A, an audio recording 232 may be selected for the portion of the carrier prompt, "but is now scheduled to depart at," to be prosodically compatible with the following word carrying contrastive stress. Developer 220 may supply an audio recording 232 of this portion of the carrier prompt, with metadata 234 indicating that it is meant to be used in a position immediately preceding a token rendered with contrastive stress. Such an audio recording may have been recorded from the speech of a voice talent who spoke the phrase with contrastive stress on the following word. In so doing, the voice talent may have placed an increased pitch, fundamental frequency, amplitude, duration, etc. target on the word carrying contrastive stress, and may have naturally produced the preceding carrier phrase with increasing parameter contours to lead up to the maximum target. It should be appreciated, however, that the foregoing description is merely exemplary, and any suitable technique(s) may be used to implement contrastive stress in CPR synthesis, as aspects of the present invention are not limited in this respect.

It should be appreciated that the foregoing are merely examples, and that a system such as synthesis system 200 may generate synthetic speech with contrastive stress using various different processing methods in various embodiments in accordance with the present disclosure. Having identified one or more portions of a text input to be rendered to carry contrastive stress through any suitable technique as described herein, it should be appreciated that synthesis system 200 may utilize any available synthesis technique to generate an audio speech output with the identified portion(s) carrying contrastive stress, including any of the various synthesis techniques described herein or any other suitable synthesis techniques. In addition, synthesis system 200 may identify the portion(s) to be rendered to carry contrastive stress using any suitable technique, as aspects of the present invention are not limited to any particular technique for identifying locations of contrastive stress.

For example, in some alternative embodiments, a synthesis system such as synthesis system 200 may identify portions of a text input to be rendered as speech with contrastive stress without reference to any annotations or tags included in the text input. In such embodiments, developer 220 need not program speech-enabled application 210 to generate any annotations or mark-up, and speech-enabled application 210 may generate text input corresponding to desired speech output entirely in plain text. An example of such a text input is text input 350, illustrated in FIG. 3B. As shown in FIG. 3B, text input 350 is read across the top line of the top portion of FIG. 3B, continuing at label "A" to the top line of the middle portion of FIG. 3B, and continuing further at label "E" to the top line of the bottom portion of FIG. 3B.

In this example, the desired speech output is, "The time is currently 9:42 a.m. Would you like to depart at 10:30 a.m., 11:30 a.m., or 12:30 p.m.?" Text input 350 corresponds to a plain text transcription of this desired speech output without any added annotations or mark-up. The notation for the times of day in the example of FIG. 3B is different from that in the example of FIG. 3A. It should be appreciated that any of various abbreviations and/or numerical and/or symbolic notation conventions may be used by speech-enabled application 210 in generating text input containing a text transcription of a desired speech output, as aspects of the present invention are not limited in this respect.

In this example, speech-enabled application 210 may be, for instance, an IVR application at a kiosk in a train station, with which a user interacts through speech to purchase a train ticket. Such a speech-enabled application 210 may be programmed to generate text input 350 in response to a user indicating a desire to purchase a ticket for a particular destination and/or route for the current day. Text input 300 may be generated by inserting appropriate content prompts into the blank fields in a carrier prompt, "The time is currently _____. Would you like to depart at _____, _____, or _____?" Speech-enabled application 210 may be programmed, for example, to determine the current time of day, and the times of departure of the next three trains departing after the current time of day on the desired route, and to insert these times as content prompts in the blank fields of the carrier prompt. Speech-enabled application 210 may transmit the text input 350 thus generated to synthesis system 200 to be rendered as synthetic speech.

Synthesis system 200 may be programmed, e.g., through a tokenizer implemented as part of front-end 250, to parse text input 350 into a sequence of individual tokens on the order of single words. In the illustration of FIG. 3B, the individual parsed tokens are represented as separated by white space in the normalized orthography 360. As shown in FIG. 3B, normalized orthography 360 is read across the second line of the top portion of FIG. 3B, continuing at label "B" to the second line of the middle portion of FIG. 3B, and continuing further at label "F" to the second line of the bottom portion of FIG. 3B. Thus, in this example, "The time is currently" is parsed into four separate tokens, and the time "9:42 a.m." is parsed into a single token with normalized orthography "nine_forty_two_a_m". It should be appreciated, however, that synthesis system 200 may be programmed to tokenize text input 350 using any suitable tokenization technique in accordance with any suitable tokenization rules and/or criteria, as aspects of the present invention are not limited in this respect.

A tokenizer of synthesis system 200 may also be programmed, in accordance with some embodiments of the present invention, to analyze the tokens that it parses to infer their text normalization type. For example, a tokenizer of synthesis system 200 may be programmed to determine that "9:42 a.m.", "10:30 a.m.", "11:30 a.m." and "12:30 p.m." in text input 350 are of the "time" text normalization type based on their syntax (e.g., one or two numerals, followed by a colon, followed by two numerals, followed by "a.m." or "p.m."). It should be appreciated that a tokenizer of synthesis system 200 may be programmed to identify tokens as belonging to any suitable text normalization type (examples of which were given above) using any suitable technique according to any suitable criteria, as aspects of the present invention are not limited in this respect. Also, although an example has been described in which tokenization and text normalization type identification functionalities are implemented in a tokenizer component within front-end 250 of synthesis system 200, it should be appreciated that many different structural architectures of synthesis system 200 are possible, including arrangements in which tokenization and text normalization type identification are implemented in the same or separate modules, together with or separate from front-end 250 or any other component of synthesis system 200. Either or both of the tokenization and text normalization type identification functionalities may be implemented on the same processor or processors as other components of synthesis system 200 or on different processor(s), and may be implemented in the same physical system or different physical systems, as aspects of the present invention are not limited in this respect.

Having identified the text normalization types of tokens of text input 350, synthesis system 200 may, e.g., through front-end 250, generate text normalization type markers 380 to mark portions of text input 350 of certain text normalization types. As shown in FIG. 3B, text normalization type markers 380 are read across the fourth line of the top portion of FIG. 3B, continuing at label "D" to the fourth line of the middle portion of FIG. 3B, and continuing further at label "H" to the fourth line of the bottom portion of FIG. 3B. Example text normalization type markers 380 include [begin time] and [end time] markers for each of the four times of day contained in text input 350. Using similar processing as described above with reference to the example of FIG. 3A, in the example of FIG. 3B synthesis system 200 may also, e.g., through front-end 250, generate sentence/phrase markers 370. As shown in FIG. 3B, sentence/phrase markers 370 are read across the third line of the top portion of FIG. 3B, continuing at label "C" to the third line of the middle portion of FIG. 3B, and continuing further at label "G" to the third line of the bottom portion of FIG. 3B.

Once synthesis system 200 has identified the text normalization types of the tokens of text input 350, it may identify a plurality of tokens in text input 350 of the same text normalization type. As discussed above, tokens or fields of the same text normalization type may be candidates for contrastive stress patterns to be applied, in certain circumstances. In the example text input 350 of FIG. 3B, the four tokens "9:42 a.m.", "10:30 a.m.", "11:30 a.m." and "12:30 p.m." are of the same text normalization type, "time". However, only the three times "10:30 a.m.", "11:30 a.m." and "12:30 p.m." are meant to contrast with each other, as they are a set of alternative times for departure, and a listener's attention may benefit from being drawn to the differences between them to make a selection among them. The first time, "9:42 a.m.", is the current time, and is separate from and does not participate in the contrastive pattern between the other three times.

In some embodiments, synthesis system 200 may be programmed to identify which tokens of the same text normalization type should participate in a contrastive stress pattern with each other, and which should not, based on syntactic patterns that may involve one or more linking tokens or sequences of tokens. In the example of FIG. 3B, synthesis system 200 may be programmed to identify the word "or" as a linking token associated with one or more patterns of contrastive stress, and/or the syntactic pattern "_____, _____ or _____" as associated with one or more specific patterns of contrastive stress. Thus, based on their positions in the syntax of text input 350 in relation to the linking token "or", the times "10:30 a.m.", "11:30 a.m." and "12:30 p.m." may be identified by synthesis system 200 as a plurality of fields to which a contrastive stress pattern should be applied, to the exclusion of the separate time "9:42 a.m.". Other examples of linking tokens that may be recognized by synthesis system 200 have been provided above; it should be appreciated that synthesis system 200 may identify tokens to which contrastive stress patterns are to be applied with reference to any suitable linking token(s) or sequence(s) of linking tokens and/or any suitable syntactic patterns involving linking tokens or not involving linking tokens, as aspects of the present invention are not limited in this respect.

As discussed above, in some embodiments, synthesis system 200 may select a particular contrastive stress pattern to apply to a plurality of contrasting tokens or fields based on their ordering and/or their syntactic relationships to various identified linking tokens in the text input. In some examples, as discussed above, a selected contrastive stress pattern may involve different levels of stress or emphasis applied to different ones of the contrasting tokens. In the example of FIG. 3B, synthesis system 200 may apply a contrastive stress pattern that assigns different levels of contrastive stress to each of the tokens "10:30 a.m." (stress level 1), "11:30 a.m." (stress level 2), and "12:30 p.m." (stress level 3). The result of such a contrastive stress pattern may be that the first of three items that contrast is emphasized slightly, the second of the three contrasting items is emphasized more, and the third of the three items is emphasized even more, to highlight the compounding differences between the three. However, this is merely one example, and it should be appreciated that synthesis system 200 may be programmed to apply any suitable contrastive stress pattern (including evenly applied stress) to contrasting tokens of the same text normalization type according to any suitable criteria, as aspects of the present invention are not limited in this regard.

Having identified the three tokens of text input 350 to which a contrastive stress pattern is to be applied, synthesis system 200 may in some embodiments proceed to identify the specific portion(s) of the contrasting tokens and/or their normalized orthography to be rendered to actually carry the contrastive stress, through processing similar to that described above with reference to the example of FIG. 3A. In the example of FIG. 3B, the "ten", "eleven" and "twelve" of the times "10:30", "11:30" and "12:30" are the portions that differ; therefore, synthesis system 200 may identify these portions as the specific words to carry contrastive stress through increased pitch, amplitude, duration and/or other appropriate parameters as discussed above. In addition, the "p.m." portion of "12:30 p.m." differs from the two preceding "a.m." portions; therefore, synthesis system 200 may identify the "p.m." portion as another to carry contrastive stress. Synthesis system 200 may then generate stress markers 390, using any suitable technique for generating markers, to mark the portions "ten", "eleven", "twelve" and "p.m." that are assigned to carry contrastive stress. As shown in FIG. 3B, stress markers 390 are read across the bottom line of the middle portion of FIG. 3B, continuing at label "I" to the bottom line of the bottom portion of FIG. 3B.

As illustrated in the example of FIG. 3B, stress markers 390 include "stress1", "stress2" and "stress3" labels to mark the three different levels of stress or emphasis assigned by synthesis system 200 to the different contrasting tokens of text input 350. As discussed above, such markers may in various embodiments be compared with metadata to select appropriate audio recordings for rendering the different tokens using CPR synthesis, or used to generate appropriate pitch, amplitude, duration, etc. targets during the portions carrying contrastive stress for use in TTS synthesis. The resulting synthetic audio speech output may speak the three contrasting tokens with different levels of emphasis, as embodied through increasing levels of intensity of selected voice and/or synthesis parameters. For example, the "ten" in "10:30 a.m." may be rendered as speech with a slightly increased pitch, amplitude and/or duration than the baseline level that would be used in the absence of contrastive stress; the "eleven" in "11:30 a.m." may be rendered as speech with higher increased pitch, amplitude and/or duration; and the "twelve" and the "p.m." in "12:30 p.m." may be rendered as speech with the highest increased pitch, amplitude and/or duration relative to the baseline.

It should be appreciated that any suitable amount(s) of pitch, amplitude and/or duration increases, and/or other synthesis parameter variations, may be used to generate speech carrying contrastive stress, as aspects of the present invention are not limited in this respect. In one example, synthesis system 200 may be programmed to generate speech carrying contrastive stress using the following changes relative to standard, unemphasized synthetic speech: for moderate emphasis, one semitone increase in pitch, three decibel increase in amplitude, and 10% increase in spoken output duration; for strong emphasis: two semitone increase in pitch, 4.5 decibel increase in amplitude, and 20% increase in spoken output duration.

Other techniques for identifying one or more portions of a text input to carry contrastive stress in the corresponding synthetic speech output are possible, as aspects of the present invention are not limited in this respect. In the foregoing, examples have been provided in which the speech-enabled application 210 and its developer 220 need do little analysis of a desired speech output to identify portions to be rendered with contrastive stress. In some embodiments, as discussed above, speech-enabled application 210 may generate nothing but a plain text transcription of a desired speech output with no indication of where contrastive stress is desired, and all the work of identifying locations of contrastive stress and appropriate contrastive stress patterns may be performed by synthesis system 200. In some embodiments, speech-enabled application 210 may include one or more indications (e.g., through SSML mark-up tags, or in other suitable ways) of the text normalization types of various fields, and it may be up to synthesis system 200 to identify which fields apply to a contrastive stress pattern. In other embodiments, speech-enabled application 210 may include one or more indications of fields of the same text normalization type for which a contrastive stress pattern is specifically desired, and synthesis system 200 may proceed to identify the specific portions of those fields to be rendered to carry contrastive stress. However, it should be appreciated that other embodiments are also contemplated, for example in which speech-enabled application 210 shoulders even more of the processing load in marking up a text input for rendering with contrastive stress.

In some embodiments, speech-enabled application 210 may itself be programmed to identify the specific portions of contrasting fields or tokens to be rendered to actually carry contrastive stress. In such embodiments, many of the functions described above as being performed by synthesis system 200 may be programmed into speech-enabled application 210 to be performed locally. For example, in some embodiments, speech-enabled application 210 may be programmed to identify tokens of the same text normalization type within a desired speech output, identify appropriate contrastive stress patterns to be applied to the contrasting tokens, identify portions of the tokens that differ, and assign specific portions on the order of single words or syllables to carry contrastive stress. Speech-enabled application 210 may be programmed to mark these specific portions using one or more annotations or tags, and to transmit the marked-up text input to synthesis system 200 for rendering as audio speech through CPR and/or TTS synthesis. Such embodiments may require more complex programming of speech-enabled application 210 by developer 220, but may allow for a simpler synthesis system 200 when the work of assigning contrastive stress is already done locally on the client side (i.e., at speech-enabled application 210).

In yet other embodiments, all processing to synthesize speech output with contrastive stress may be performed locally at a speech-enabled application. For example, in some embodiments, a developer may supply a speech-enabled application with access to a dataset of audio prompt recordings for use in CPR synthesis, and may program the speech-enabled application to construct output speech prompts by concatenating specific prompt recordings that are hard-coded by the developer into the programming of the speech-enabled application. For implementing contrastive stress in accordance with some embodiments of the present invention, the speech-enabled application may be programmed to issue call-outs to a library of function calls that deal with applying contrastive stress to restricted sequences of text.

In some embodiments, when a speech-enabled application identifies a plurality of fields of a desired speech output of the same text normalization type for which a contrastive stress pattern is desired, the application may be programmed to issue a call-out to a function for applying contrastive stress to those fields. For example, the speech-enabled application may pass the times "10:45 a.m." and "11:45 a.m." as text parameters to a function programmed to map the two times to sequences of audio recordings that contrast with each other in a contrastive stress pattern. The function may be implemented using any suitable techniques, for example as software code stored on one or more computer-readable storage media and executed by one or more processors, in connection with the speech-enabled application. The function may be programmed with some functionality similar to that described above with reference to synthesis system 200, for example to use rules specific to the current language and text normalization type to convert the plurality of text fields to word forms and identify portions that differ between them. The function may then assign contrastive stress to be carried by the differing portions.

In some embodiments, a function as described above may return to the speech-enabled application one or more indications of which portion(s) of the plurality of fields should be rendered to carry contrastive stress. Such indications may be in the form of markers, mark-up tags, and/or any other suitable form, as aspects of the present invention are not limited in this respect. After receiving such indication(s) returned from the function call, the speech-enabled application may then select appropriate audio recordings from its prompt recording dataset to render the fields as speech with accordingly placed contrastive stress. In other embodiments, the function itself may select appropriate audio recordings from the prompt recording dataset to render the plurality of fields as speech with contrastive stress as described above, and return the filenames of the selected audio recordings or the audio recordings themselves to the speech-enabled application proper. The speech-enabled application may then concatenate the audio recordings returned by the function call (e.g., the content prompts) with the other audio recordings hard-coded into the application (e.g., the carrier prompts) to form the completed synthetic speech output with contrastive stress.

Figure 4:
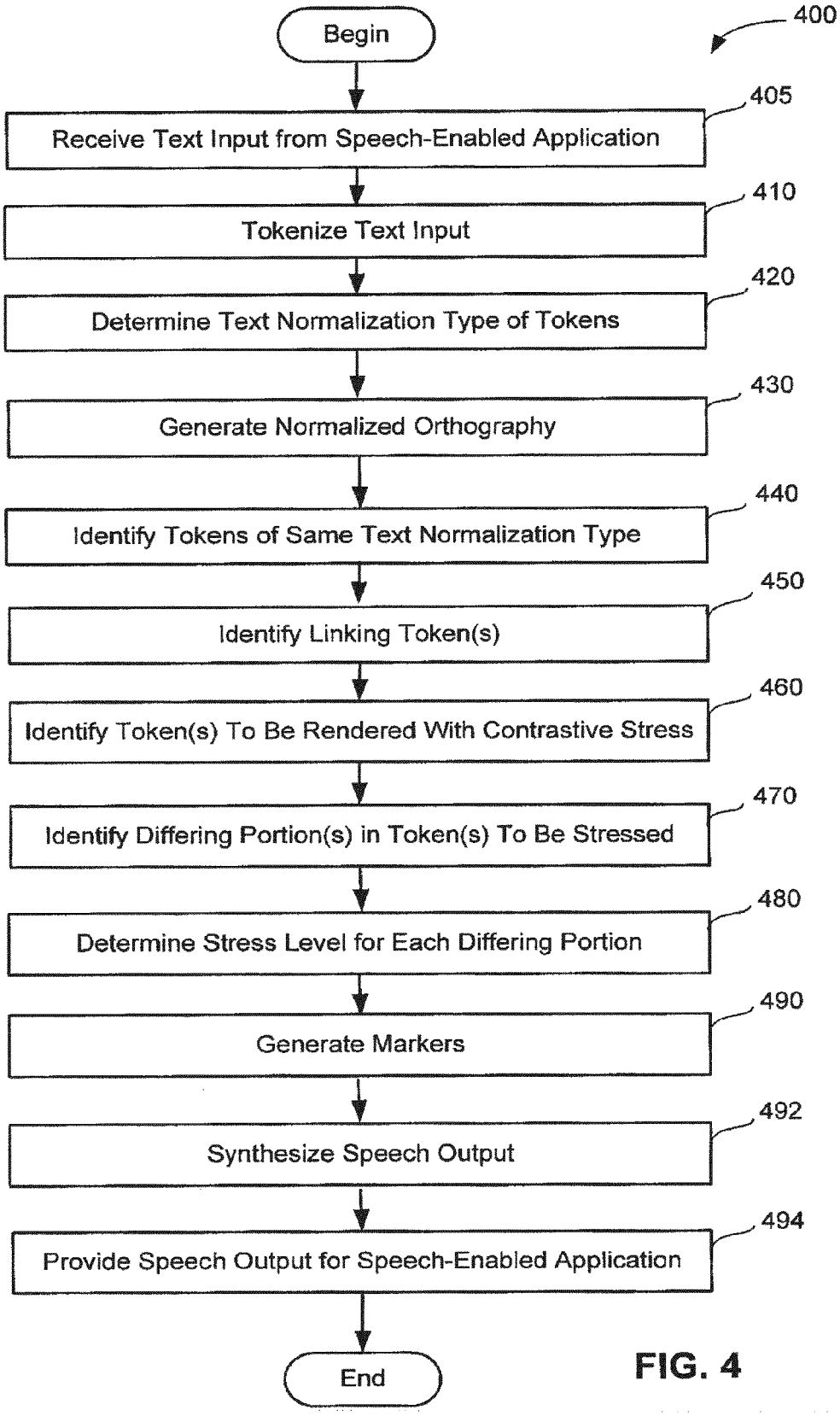
FIG. 4 is a flow chart illustrating an exemplary method for providing speech output for a speech-enabled application, in accordance with some embodiments of the present invention.

FIG. 4 illustrates an exemplary method 400 for use by synthesis system 200 or any other suitable system for providing speech output for a speech-enabled application in accordance with some embodiments of the present invention. Method 400 begins at act 405, at which text input may be received from a speech-enabled application. At act 410, the text input may be tokenized, i.e., parsed into individual tokens on the order of single words. At act 420, the text normalization types of at least some of the tokens of the text input may be identified. Examples of text normalization types that may be recognized by the synthesis system have been provided above. As discussed above, text normalization types of various tokens may be identified with reference to annotations or tags included in the text input by the speech-enabled application that specifically identify the text normalization types of the associated tokens, or the text normalization types may be inferred by the synthesis system based on the format and/or syntax of the tokens. At act 430, a normalized orthography corresponding to the text input may be generated. As discussed above, the normalized orthography may represent a standardized spelling out of the words included in the text input, which for some tokens may depend on their text normalization type.

At act 440, at least one set of tokens of the same text normalization type may be identified, based on the text normalization types identified in act 420. As discussed above, a set of tokens of the same text normalization type in a text input may be candidates for application of a contrastive stress pattern; however, not all tokens of the same text normalization type within a text input may participate in the same contrastive stress pattern. In some embodiments, tokens for which a contrastive stress pattern is to be applied may be specifically designated by the speech-enabled application through one or more annotations, such as SSML "say-as" tags with a "detail" attribute valued as "contrastive". In other embodiments, the synthesis system may identify which tokens are to participate in a contrastive stress pattern based on their syntactic relationships with each other and any appropriate linking tokens identified within the text input.

One or more linking tokens in the text input may be identified at act 450. Examples of suitable linking tokens have been provided above. As discussed above, linking tokens may be used in the processing performed by the synthesis system when they appear in certain syntactic patterns with relation to tokens of the same text normalization type. From such patterns, the synthesis system may identify which of the tokens of the same text normalization type are to participate in a contrastive stress pattern, if such tokens were not specifically designated as "contrastive" by one or more indications (e.g., annotations) included in the text input. In addition, based on the order of the tokens to which a contrastive stress pattern is to be applied, and/or based on any linking tokens identified and/or their syntactic patterns, synthesis system may select a particular contrastive stress pattern to apply to the contrasting tokens. As discussed above, the particular contrastive stress pattern selected may involve rendering only one, some or all of the contrasting tokens with contrastive stress, and/or may involve assigning different levels of stress to different ones of the contrasting tokens. Thus, based on the selected contrastive stress pattern, one or more of the tokens may be identified at act 460 to be rendered with contrastive stress.

At act 470, the token(s) to be rendered with contrastive stress, and/or their normalized orthography, may be compared with the other token(s) to which the contrastive stress pattern is applied, to identify the specific portion(s) of the token(s) that differ. At act 480, a level of contrastive stress may be determined for each portion that differs from a corresponding portion of the other token(s) and/or their normalized orthography. If a token to be rendered with contrastive stress differs in its entirety from the other contrasting token(s), then light emphasis may be applied to the entire token, or no stress may be applied to the token at all. If some portions of the token differ from one or more other contrasting tokens and some do not, then a level of contrastive stress may be assigned to be carried by each portion that differs. In some embodiments, the same level of emphasis may be assigned to any portion of the speech output carrying contrastive stress. However, in some embodiments, different levels of contrastive stress may be assigned to different contrasting tokens and/or portions of contrasting tokens, based on the selected contrastive stress pattern, as discussed in greater detail above.

At act 490, markers may be generated to delineate the portions of the text input and/or normalized orthography assigned to carry contrastive stress, and/or to indicate the level of contrastive stress assigned to each such portion. At act 492, the markers may be used, in combination with the text input, normalized orthography and/or a corresponding phoneme sequence, in further processing by the synthesis system to synthesize a corresponding audio speech output. As discussed above, any of various synthesis techniques may be used, including CPR, concatenative TTS, articulatory or formant synthesis, and/or others. Each portion of the text input labeled by the markers as carrying contrastive stress may be appropriately rendered as audio speech carrying contrastive stress, in accordance with the synthesis technique(s) used. The resulting speech output may exhibit increased parameters such as pitch, fundamental frequency, amplitude and/or duration during the portion(s) carrying contrastive stress, in relation to the baseline values of such parameters that would be exhibited by the same speech output if it were not carrying contrastive stress. In addition, other portions of the speech output, not carrying contrastive stress, may be rendered to be prosodically compatible with the portion(s) carrying contrastive stress, as described in further detail above. Method 400 may then end at act 494, at which the speech output thus produced with contrastive stress may be provided for the speech-enabled application.

Figure 5:
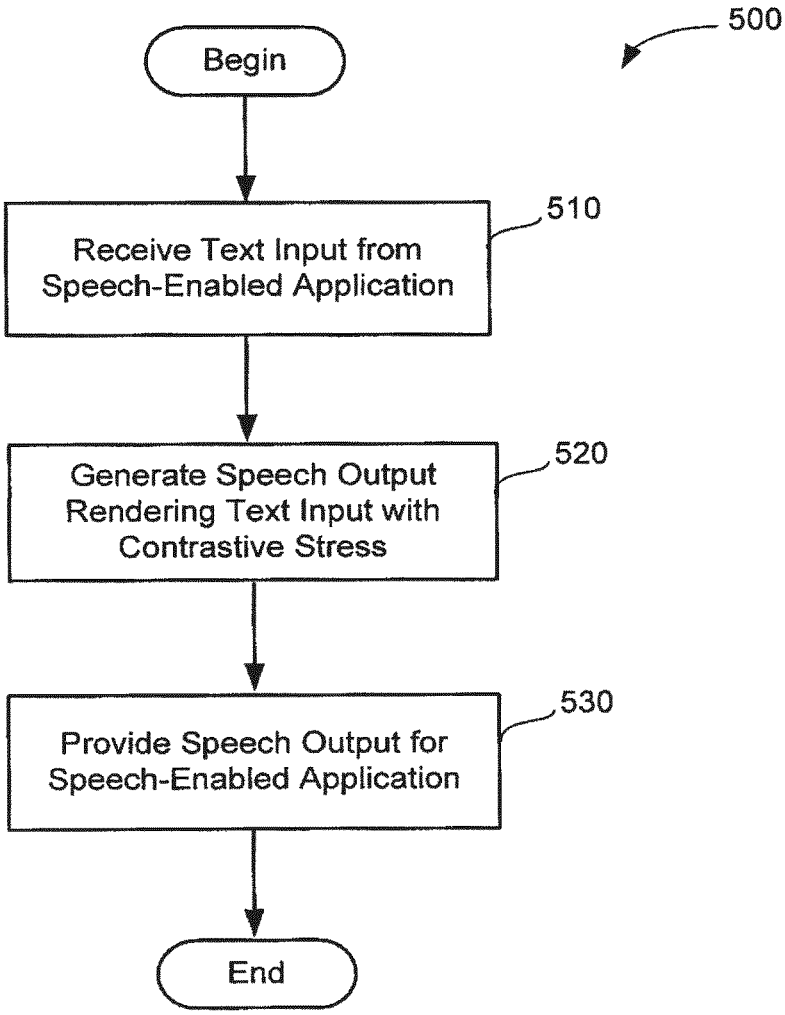
FIG. 5 is a flow chart illustrating an exemplary method for providing speech output for a speech-enabled application, in accordance with some embodiments of the present invention.

It should be appreciated from the foregoing descriptions that some embodiments in accordance with the present disclosure are directed to a method 500 for providing speech output for a speech-enabled application, as illustrated in FIG. 5. Method 500 may be performed, for example, by a synthesis system such as synthesis system 200, or any other suitable system, machine and/or apparatus. Method 500 begins at act 510, at which text input may be received from a speech-enabled application. The text input may comprise a text transcription of a desired speech output. At act 520, speech output rendering the text input with contrastive stress may be generated. The speech output may include audio speech output corresponding to at least a portion of the text input, including at least one portion carrying contrastive stress to contrast with at least one other portion of the audio speech output. Method 500 ends at act 530, at which the speech output may be provided for the speech-enabled application.

Figure 6:
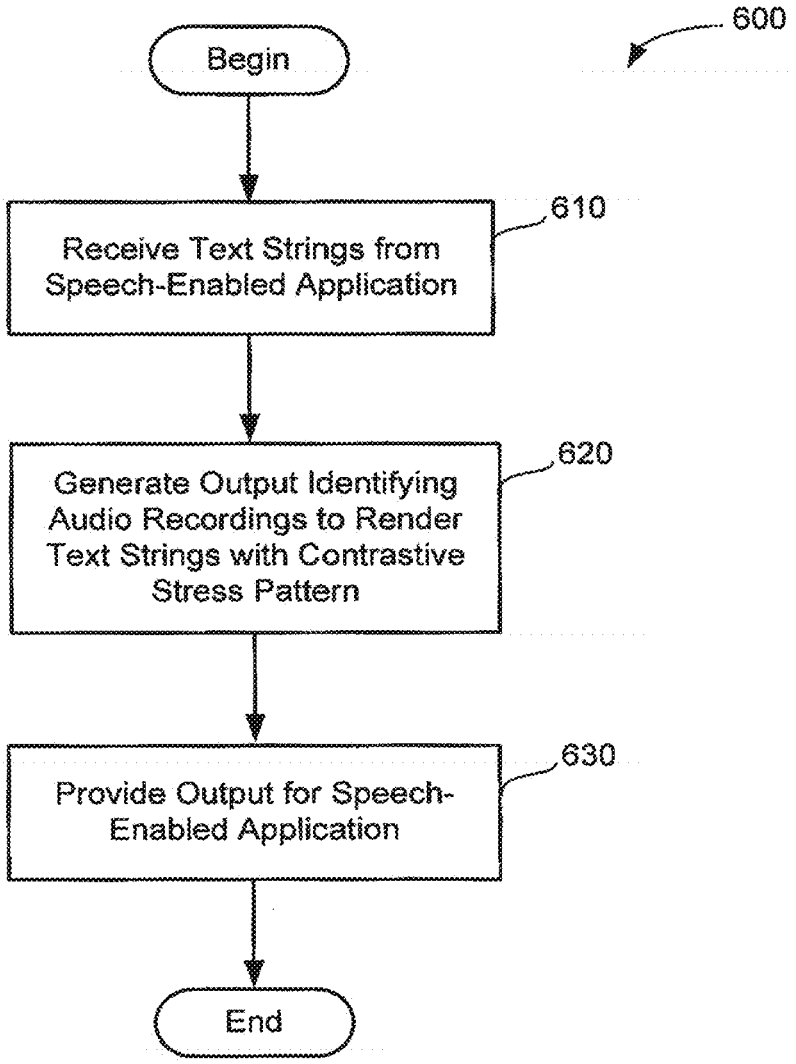
FIG. 6 is a flow chart illustrating an exemplary method for use with a speech-enabled application, in accordance with some embodiments of the present invention.

It should further be appreciated that some embodiments are directed to a method 600 for use with a speech-enabled application, as illustrated in FIG. 6. Method 600 may be performed, for example, by a system executing a function to which the speech-enabled application passes fields of text representing portions of a desired speech output to be contrasted with each other, or by any other suitable system, machine and/or apparatus. Method 600 begins at act 610, at which input comprising a plurality of text strings may be received from a speech-enabled application. At act 620, speech synthesis output corresponding to the plurality of text strings may be generated. The output may identify a plurality of audio recordings to render the text strings as speech with a contrastive stress pattern. As discussed above, the contrastive stress pattern may involve applying stress to one, some or all of the plurality of text strings, such that one or more identified audio recordings corresponding to one, some or all of the plurality of text strings carry contrastive stress. Thus, at least one of the plurality of audio recordings may be selected to render at least one portion of at least one of the plurality of text strings as speech carrying contrastive stress, to contrast with at least one rendering of at least one other of the plurality of text strings. As discussed above, the output may identify the audio recordings by returning their filenames to the speech-enabled application, by returning the audio recordings themselves to the speech-enabled application, by returning new data formed by concatenating the audio recordings to the speech-enabled application, or in any other suitable way, as aspects of the present invention are not limited in this respect. Method 600 ends at act 630, at which the output may be provided for the speech-enabled application.

Figure 7:
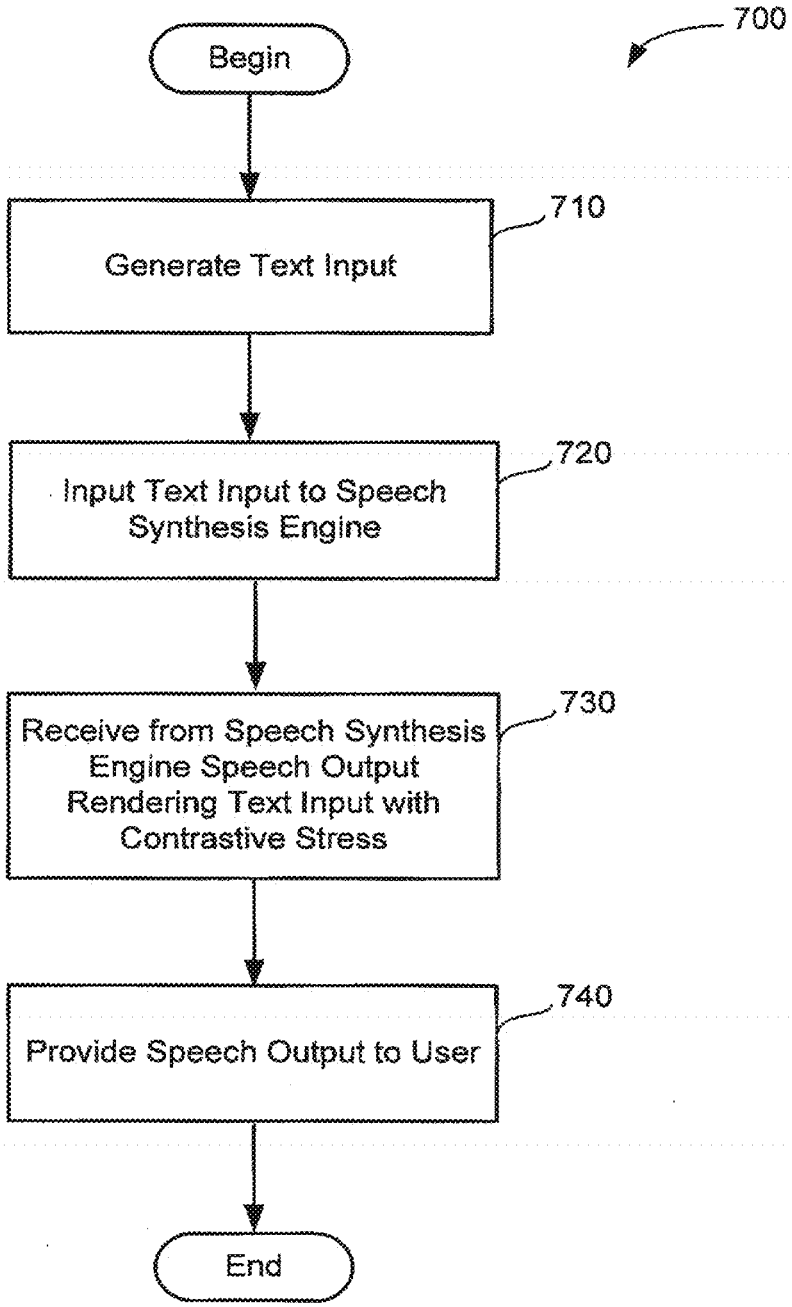
FIG. 7 is a flow chart illustrating an exemplary method for providing speech output via a speech-enabled application, in accordance with some embodiments of the present invention.

In addition, it should be appreciated that some embodiments in accordance with the present disclosure are directed to a method 700 for providing speech output via a speech-enabled application, as illustrated in FIG. 7. Method 700 may be performed, for example, by a system executing a speech-enabled application such as speech-enabled application 210, or by any other suitable system, machine and/or apparatus. Method 700 begins at act 710, at which a text input may be generated. The text input may include a text transcription of a desired speech output. In some embodiments, the text input may also include one or more indications, such as SSML tags or any other suitable indication(s), that a contrastive stress pattern is desired in association with at least one portion of the text input. In some embodiments, generating such indication(s) may include identifying a plurality of fields of the text input for which the contrastive stress pattern is desired, and/or identifying one or more specific portions of the text input to be rendered to actually carry the contrastive stress. In some embodiments, identifying such specific portion(s) to carry contrastive stress may be performed by passing the plurality of fields for which the contrastive stress pattern is desired to a function that performs the identification.

At act 720, the generated text input may be input to one or more speech synthesis engines. At act 730, speech output corresponding to at least a portion of the text input may be received from the speech synthesis engine(s). The speech output may include audio speech output including at least one portion carrying contrastive stress to contrast with at least one other portion of the audio speech output. Method 700 ends at act 740, at which the audio speech output may be provided to one or more user(s) of the speech-enabled application.

Figure 8:
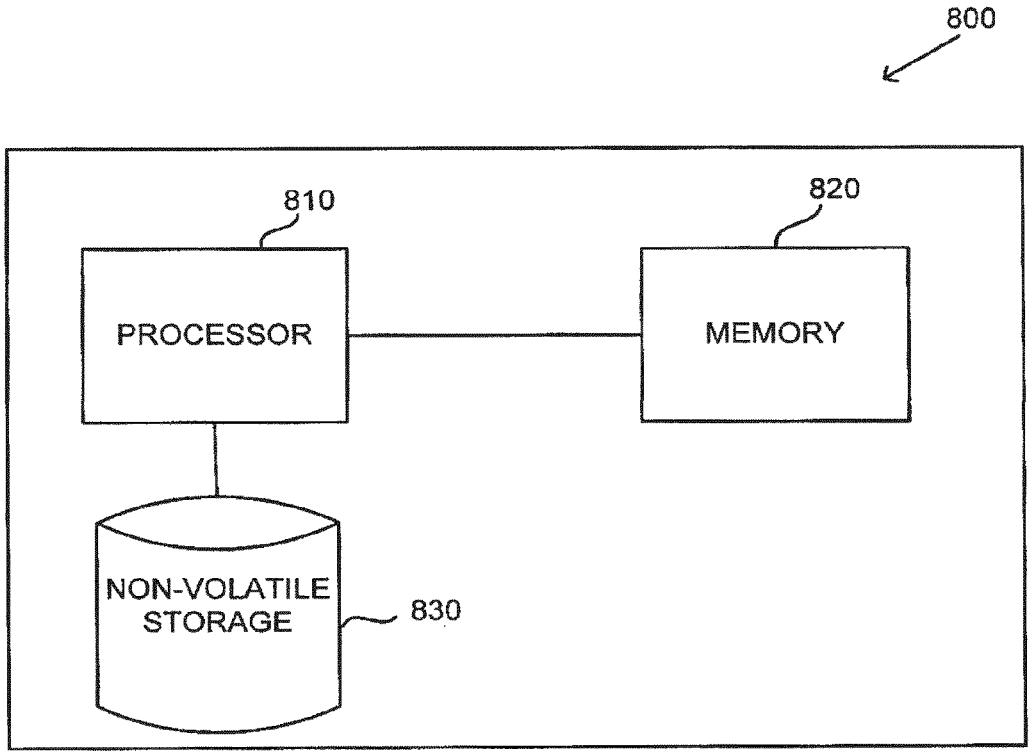
FIG. 8 is a block diagram of an exemplary computer system on which aspects of the present invention may be implemented.

A synthesis system for providing speech output for a speech-enabled application in accordance with the techniques described herein may take any suitable form, as aspects of the present invention are not limited in this respect. An illustrative implementation using one or more computer systems 800 that may be used in connection with some embodiments of the present invention is shown in FIG. 8. The computer system 800 may include one or more processors 810 and one or more tangible, non-transitory computer-readable storage media (e.g., memory 820 and one or more non-volatile storage media 830, which may be formed of any suitable non-volatile data storage media). The processor 810 may control writing data to and reading data from the memory 820 and the non-volatile storage device 830 in any suitable manner, as the aspects of the present invention described herein are not limited in this respect. To perform any of the functionality described herein, the processor 810 may execute one or more instructions stored in one or more computer-readable storage media (e.g., the memory 820), which may serve as tangible, non-transitory computer-readable storage media storing instructions for execution by the processor 810.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation of various embodiments of the present invention comprises at least one tangible, non-transitory computer-readable storage medium (e.g., a computer memory, a floppy disk, a compact disk, and optical disk, a magnetic tape, a flash memory, circuit configurations in Field Programmable Gate Arrays or other semiconductor devices, etc.) encoded with one or more computer programs (i.e., a plurality of instructions) that, when executed on one or more computers or other processors, performs the above-discussed functions of various embodiments of the present invention. The computer-readable storage medium can be transportable such that the program(s) stored thereon can be loaded onto any computer resource to implement various aspects of the present invention discussed herein. In addition, it should be appreciated that the reference to a computer program which, when executed, performs the above-discussed functions, is not limited to an application program running on a host computer. Rather, the term computer program is used herein in a generic sense to reference any type of computer code (e.g., software or microcode) that can be employed to program a processor to implement the above-discussed aspects of the present invention.

Various aspects of the present invention may be used alone, in combination, or in a variety of arrangements not specifically discussed in the embodiments described in the foregoing and are therefore not limited in their application to the details and arrangement of components set forth in the foregoing description or illustrated in the drawings. For example, aspects described in one embodiment may be combined in any manner with aspects described in other embodiments.

Also, embodiments of the invention may be implemented as one or more methods, of which an example has been provided. The acts performed as part of the method(s) may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A method for use with a speech-enabled application, the method comprising:

receiving, from the speech-enabled application, input comprising a plurality of text strings;

identifying a first portion of a first text string of the plurality of text strings as differing from a corresponding first portion of a second text string of the plurality of text strings, and a second portion of the first text string as not differing from a corresponding second portion of the second text string;

assigning contrastive stress to the first portion of the first text string and/or to the corresponding first portion of the second text string, but not to the second portion of the first text string, and not to the corresponding second portion of the second text string;

generating, using at least one computer system, speech synthesis output to render the plurality of text strings as speech having the assigned contrastive stress; and providing the speech synthesis output for the speech-enabled application.

2. The method of claim 1, wherein the identifying comprises identifying the first portion of the first text string as differing from the corresponding first portion of the second text string based at least in part on a normalized orthography of the first and second text strings.

3. The method of claim 1, wherein the first and second text strings represent different numerical fields within a larger text string.

4. The method of claim 3, wherein the numerical fields are selected from the group consisting of: currency fields, date fields, digit sequence fields, number fields, fractional number fields, ordinal number fields, telephone number fields, flight number fields, street number fields, time fields, and zipcode fields.

5. The method of claim 1, wherein the receiving comprises receiving the first and second text strings as first and second parameters passed to a function called by the speech-enabled application to render the first and second text strings with a contrastive stress pattern.

6. The method of claim 1, wherein the speech synthesis output comprises identification of a plurality of audio recordings to render the plurality of text strings as speech, at least one of the plurality of audio recordings being selected to render the first portion of the first text string and/or the first portion of the second text string as speech carrying contrastive stress.

7. The method of claim 1, wherein the speech synthesis output comprises an indication of the first portion of the first text string and/or the corresponding first portion of the second text string as being assigned contrastive stress.

8. At least one non-transitory computer-readable storage medium encoded with a plurality of computer-executable instructions that, when executed, perform a method for use with a speech-enabled application, the method comprising:

receiving, from the speech-enabled application, input comprising a plurality of text strings;

identifying a first portion of a first text string of the plurality of text strings as differing from a corresponding first portion of a second text string of the plurality of text strings, and a second portion of the first text string as not differing from a corresponding second portion of the second text string;

assigning contrastive stress to the first portion of the first text string and/or to the corresponding first portion of the second text string, but not to the second portion of the first text string, and not to the corresponding second portion of the second text string;

generating speech synthesis output to render the plurality of text strings as speech having the assigned contrastive stress; and providing the speech synthesis output for the speech-enabled application.

9. The at least one non-transitory computer-readable storage medium of claim 8, wherein the identifying comprises identifying the first portion of the first text string as differing from the corresponding first portion of the second text string based at least in part on a normalized orthography of the first and second text strings.

10. The at least one non-transitory computer-readable storage medium of claim 8, wherein the first and second text strings represent different numerical fields within a larger text string.

11. The at least one non-transitory computer-readable storage medium of claim 10, wherein the numerical fields are selected from the group consisting of: currency fields, date fields, digit sequence fields, number fields, fractional number fields, ordinal number fields, telephone number fields, flight number fields, street number fields, time fields, and zipcode fields.

12. The at least one non-transitory computer-readable storage medium of claim 8, wherein the receiving comprises receiving the first and second text strings as first and second parameters passed to a function called by the speech-enabled application to render the first and second text strings with a contrastive stress pattern.

13. The at least one non-transitory computer-readable storage medium of claim 8, wherein the speech synthesis output comprises identification of a plurality of audio recordings to render the plurality of text strings as speech, at least one of the plurality of audio recordings being selected to render the first portion of the first text string and/or the first portion of the second text string as speech carrying contrastive stress.

14. The at least one non-transitory computer-readable storage medium of claim 8, wherein the speech synthesis output comprises an indication of the first portion of the first text string and/or the corresponding first portion of the second text string as being assigned contrastive stress.

15. A method for generating speech output via a speech-enabled application, the method comprising:

generating, using at least one computer system executing the speech-enabled application, a plurality of text strings, each of the plurality of text strings corresponding to a portion of a desired speech output;

inputting the plurality of text strings to at least one software module configured to identify a first portion of a first text string of the plurality of text strings as differing from a corresponding first portion of a second text string of the plurality of text strings, and a second portion of the first text string as not differing from a corresponding second portion of the second text string;

receiving, from the at least one software module, speech synthesis output to render the plurality of text strings with contrastive stress assigned to the first portion of the first text string and/or to the corresponding first portion of the second text string, but not to the second portion of the first text string, and not to the corresponding second portion of the second text string; and generating, using the speech synthesis output, an audio speech output corresponding to the desired speech output.

16. The method of claim 15, wherein the at least one software module is configured to identify the first portion of the first text string as differing from the corresponding first portion of the second text string based at least in part on a normalized orthography of the first and second text strings.

17. The method of claim 15, wherein the first and second text strings represent different numerical fields within a larger text string.

18. The method of claim 17, wherein the numerical fields are selected from the group consisting of: currency fields, date fields, digit sequence fields, number fields, fractional number fields, ordinal number fields, telephone number fields, flight number fields, street number fields, time fields, and zipcode fields.

19. The method of claim 15, wherein the inputting comprises passing the first and second text strings as first and second parameters to a function called by the speech-enabled application to render the first and second text strings with a contrastive stress pattern.

20. The method of claim 15, wherein the speech synthesis output comprises identification of a plurality of audio recordings to render the plurality of text strings as speech, at least one of the plurality of audio recordings being selected to render the first portion of the first text string and/or the first portion of the second text string as speech carrying contrastive stress.

* * * * *